US009715883B2

(12) United States Patent
Geiger et al.

(10) Patent No.: US 9,715,883 B2
(45) Date of Patent: Jul. 25, 2017

(54) MULTI-MODE AUDIO CODEC AND CELP CODING ADAPTED THEREFORE

(71) Applicant: Fraunhofer-Gesellschaft zur Foerderung der angewandten Forschung e.V., Munich (DE)

(72) Inventors: Ralf Geiger, Erlangen (DE); Guillaume Fuchs, Erlangen (DE); Markus Multrus, Nuremberg (DE); Bernhard Grill, Lauf (DE)

(73) Assignee: Fraundhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/153,501

(22) Filed: May 12, 2016

(65) Prior Publication Data

US 2016/0260438 A1 Sep. 8, 2016

Related U.S. Application Data

(60) Division of application No. 14/288,091, filed on May 27, 2014, now Pat. No. 9,495,972, which is a division (Continued)

(51) Int. Cl.
*G10L 19/00* (2013.01)
*G10L 19/12* (2013.01)

(Continued)

(52) U.S. Cl.
CPC ..... *G10L 19/12* (2013.01); *G10L 19/03* (2013.01); *G10L 19/04* (2013.01); *G10L 19/083* (2013.01);

(Continued)

(58) Field of Classification Search
USPC ..... 704/200–232, 500–504
See application file for complete search history.

(56) References Cited

U.S. PATENT DOCUMENTS 5,321,793 A 6/1994 De Iacovo et al.
5,490,230 A 2/1996 Gerson et al.

(Continued)

FOREIGN PATENT DOCUMENTS

CN 1757060 4/2006
EP 2040253 3/2009

(Continued)

OTHER PUBLICATIONS

Bessette, B. et al., "A Wideband speech and audio codec at 16/24/32 kbit/s using hybrid ACELP/TCX techniques", 1999 IEEE Workshop Speech Coding Proceedings, on Porvoo, Finland , XP010345581, DOI: DOI: 10.1109/SCFT.1999.781466 ISBN:, Jun. 20-23, 1999, pp. 7-9.

(Continued)

*Primary Examiner* — Jesse Pullias
(74) *Attorney, Agent, or Firm* — Perkins Coie LLP; Michael A. Glenn

(57) ABSTRACT

In an embodiment, bitstream elements of sub-frames are encoded differentially to a global gain value so that a change of the global gain value results in an adjustment of an output level of the decoded representation of the audio content. Concurrently, the differential coding saves bits. Even further, the differential coding enables the lowering of the burden of globally adjusting the gain of an encoded bitstream. In another embodiment, a global gain control across CELP coded frames and transform coded frames is achieved by co-controlling the gain of the codebook excitation of the CELP codec, along with a level of the transform or inverse transform of the transform coded frames. In another embodi- (Continued)

ment, the gain value determination in CELP coding is performed in the weighted domain of the excitation signal.

7 Claims, 10 Drawing Sheets

Related U.S. Application Data of application No. 13/449,890, filed on Apr. 18, 2012, now Pat. No. 8,744,843, which is a continuation of application No. PCT/EP2010/065718, filed on Oct. 19, 2010.

(60) Provisional application No. 61/253,440, filed on Oct. 20, 2009.

(51) Int. Cl.
*G10L 19/083* (2013.01)
*G10L 19/20* (2013.01)
*G10L 19/03* (2013.01)
*G10L 19/04* (2013.01)

(52) U.S. Cl.
CPC ..... *G10L 19/20* (2013.01); *G10L 2019/0002* (2013.01)

(56) References Cited

U.S. PATENT DOCUMENTS

| | | | | |
|---|---|---|---|---|
| 5,495,555 | A | 2/1996 | Swaminathan | |
| 5,519,807 | A | 5/1996 | Cellario et al. | |
| 5,774,844 | A * | 6/1998 | Akagiri | H04B 14/046 704/215 |
| 6,098,039 | A * | 8/2000 | Nishida | G10L 19/0208 704/229 |
| 6,134,518 | A | 10/2000 | Cohen et al. | |
| 6,385,573 | B1 | 5/2002 | Gao et al. | |
| 6,449,596 | B1 * | 9/2002 | Ejima | G11B 20/00007 704/501 |
| 6,658,382 | B1 * | 12/2003 | Iwakami | G10L 19/0212 704/205 |
| 6,963,842 | B2 | 11/2005 | Goodwin | |
| 7,043,423 | B2 | 5/2006 | Vinton et al. | |
| 7,272,556 | B1 * | 9/2007 | Aguilar | G10L 19/093 704/201 |
| 7,933,769 | B2 | 4/2011 | Bessette | |
| 2002/0138256 | A1 | 9/2002 | Thyssen | |
| 2002/0173969 | A1 | 11/2002 | Ojanpera | |
| 2003/0009325 | A1 | 1/2003 | Kirchherr et al. | |
| 2003/0200092 | A1 | 10/2003 | Gao et al. | |
| 2005/0251387 | A1 * | 11/2005 | Jelinek | G10L 19/24 704/223 |
| 2006/0206334 | A1 | 9/2006 | Kapoor et al. | |
| 2007/0225971 | A1 | 9/2007 | Bessette | |
| 2008/0002771 | A1 | 1/2008 | Chen | |
| 2008/0027715 | A1 | 1/2008 | Rajendran et al. | |
| 2011/0035214 | A1 | 2/2011 | Morii | |

FOREIGN PATENT DOCUMENTS

| | | |
|---|---|---|
| EP | 2051244 | 4/2009 |
| JP | H08263098 | 10/1996 |
| JP | 2007525707 | 9/2007 |
| KR | 1020070107615 | 11/2007 |
| RU | 2262748 | 9/2000 |
| WO | WO 00/11659 | 3/2000 |
| WO | 2009125588 | 10/2009 |

OTHER PUBLICATIONS

Bessette, Bruno et al., "Universal Speech/Audio Coding Using Hybrid ACELP/TCX Techniques", 2005 IEEE International Conference on Acoustics, Speech and Signal Processing. Piscataway, NJ, USA. vol. 3. XP010792234, Mar. 18, 2005, 301-304.

Gournay, Philippe, "A Very Low Bit Rate Protection Layer to Increase the Robustness of the AMR-RB+ Codec against Bit Errors", Proc. 123rd Convention of AES, U.S.A., Oct. 5, 2007, pp. 1-18.

McCree, Alan et al., "A 4kb/s Hybrid MELP/CELP Speech Coding Candidate for ITU Standardization", Proc. ICASSP 2002, U.S.A., IEEE, May 13, 2002, Vo. 1, pp. 692-632.

Neuendorf, Max et al., "Unified speech and audio coding scheme for high quality at low bitrates", Neuendorf M et al.: "Unified speech and audio coding scheme for high quality at low bitrates", Acoustics, Speech and Signal Processing, 2009. ICASSP 2009. IEEE International Conference on, IEEE, Piscataway, NJ, USA, Apr. 19, 2009, pp. 1-4, XP031459151.

Ramprashad, Sean, "The Multimode Transform Predictive Coding Paradigm", Ramprashad, Sean: "The Multimode Transform Predictive Coding Paradigm", IEEE Transactions on Speech and Audio Processing, IEEE Service Center, New York, NY, USA, vol. 11, No. 2, Mar. 1, 2003, XP011079700, ISS: 1063-6676, abstract, p. 117, left-hand column.

Salami, R. et al., "8kbit/s ACELP Coding of Speech with 10ms Speech-Frame: A Candidate for CCITT Standarization,", Proc. ICASSP 1994, SA, IEEE, Apr. 19, 1994, pp. 97-100.

Salami, R. et al., "ACELP Speech Coding at 8kbit/s with a 10ms Frame: A Candidate for CCITT Standarization", Proc. IEEE Workshop on Speech Coding for Telecommunications, Canada IEEE, Oct. 13, 1993, pp. 23-24.

* cited by examiner

| FIG 1A | FIG 1 |
|---|---|
| FIG 1B | |

| FIG 1A | FIG 1 |
|---|---|
| FIG 1B | |

MULTI-MODE AUDIO CODEC AND CELP CODING ADAPTED THEREFORE

CROSS-REFERENCE TO RELATED APPLICATIONS

This application is a divisional of U.S. patent application Ser. No. 14/288,091 filed May 27, 2014, which is a divisional of U.S. patent application Ser. No. 13/449,890, filed Apr. 18, 2012 (now U.S. Pat. No. 8,744,843), which is a continuation of copending International Application No. PCT/EP2010/065718, filed Oct. 19, 2010, which claims priority from U.S. Provisional Application No. 61/253,440, filed Oct. 20, 2009, all of which are incorporated herein by reference in their entirety.

The present invention relates to multi-mode audio coding such as a unified speech and audio codec or a codec adapted for general audio signals such as music, speech, mixed and other signals, and a CELP coding scheme adapted thereto.

BACKGROUND OF THE INVENTION

It is favorable to mix different coding modes in order to code general audio signals representing a mix of audio signals of different types such as speech, music, or the like. The individual coding modes may be adapted for particular audio types, and thus, a multi-mode audio encoder may take advantage of changing the coding mode over time corresponding to the change of the audio content type. In other words, the multi-mode audio encoder may decide, for example, to encode portions of the audio signal having speech content using a coding mode especially dedicated for coding speech, and to use another coding mode(s) in order to encode different portions of the audio content representing non-speech content such as music. Linear prediction coding modes tend to be more suitable for coding speech contents, whereas frequency-domain coding modes tend to outperform linear prediction coding modes as far as the coding of music is concerned.

However, using different coding modes makes it difficult to globally adjust the gain within an encoded bitstream or, to be more precise, the gain of the decoded representation of the audio content of an encoded bitstream without having to actually decode the encoded bitstream and then re-encoding the gain-adjusted decoded representation again, which detour would inevitably decrease the quality of the gain-adjusted bitstream due to requantizations performed in re-encoding the decoded and gain-adjusted representation.

For example, in AAC, an adjustment of the output level can easily be achieved on bitstream level by changing the value of the 8-bit field "global gain". This bitstream element can simply be passed and edited, without the need for full decoding and re-encoding. Thus, this process does not introduce any quality degradation and can be undone losslessly. There are applications which actually make use of this option. For example, there is a free software called "AAC gain" [AAC gain] which applies exactly the approach just-described. This software is a derivative of the free software "MP3 gain", which applies the same technique for MPEG1/2 layer 3.

In the just-emerging USAC codec, the FD coding mode has inherited the 8-bit global gain from AAC. Thus, if USAC runs in FD-only mode, such as for higher bitrates, the functionality of level adjustment would be fully preserved, when compared to AAC. However, as soon as mode transitions are admitted, this possibility is no longer present. In the TCX mode, for example, there is also a bitstream element with the same functionality also called "global gain", which has a length of merely 7-bits. In other words, the number of bits for encoding the individual gain elements of the individual modes is primarily adapted to the respective coding mode in order to achieve a best tradeoff between spending less bits for gain control on the one hand, and on the other hand avoiding a degradation of the quality due to a too coarse quantization of the gain adjustability. Obviously, this tradeoff resulted in a different number of bits when comparing the TCX and the FD mode. In the ACELP mode of the currently emerging USAC standard, the level can be controlled via a bitstream element "mean energy", which has a length of 2-bits. Again, obviously the tradeoff between too much bits for mean energy and too less bits for mean energy resulted in a different number of bits than compared to the other coding modes, namely TCX and FD coding mode.

Thus, until now, globally adjusting the gain of a decoded representation of an encoded bitstream encoded by multi-mode coding, is cumbersome and tends to decrease the quality. Either, decoding followed by gain adjustment and re-encoding is to be performed, or the adjustment of the loudness level has to be performed heuristically merely by adapting the respective bitstream elements of the different modes influencing the gain of the respective different coding mode portions of the bitstream. However, the latter possibility is very likely to introduce artifacts into the gain-adjusted decoded representation.

SUMMARY

According to an embodiment, a multi-mode audio decoder for providing a decoded representation of audio content on the basis of an encoded bitstream may be configured to decode a global gain value per frame of the encoded bitstream, wherein a first subset of the frames being coded in a first coding mode and a second subset of the frames being coded in a second coding mode, with each frame of the second subset being composed of more than one sub-frames, decode, per sub-frame of at least a subset of the sub-frames of the second subset of frames, a corresponding bitstream element differentially to the global gain value of the respective frame, and complete decoding the bitstream using the global gain value and the corresponding bitstream element in decoding the sub-frames of the at least subset of the sub-frames of the second subset of frames and the global gain value in decoding the first subset of frames, wherein the multi-mode audio decoder is configured such that a change of the global gain value of the frames within the encoded bitstream results in an adjustment of an output level of the decoded representation of the audio content.

According to another embodiment, a multi-mode audio decoder for providing a decoded representation of an audio content on the basis of an encoded bitstream, a first subset of frames of which is CELP coded and a second subset of frames of which is transform coded, may have: a CELP decoder configured to decode a current frame of the first subset, which CELP decoder may have: an excitation generator configured to generate a current excitation of the current frame of the first subset by constructing an codebook excitation based on a past excitation and an codebook index of the current frame of the first subset within the encoded bitstream, and setting a gain of the codebook excitation based on a global gain value within the encoded bitstream; and a linear prediction synthesis filter configured to filter the current excitation based on linear prediction filter coefficients for the current frame of the first subset within the encoded bitstream; a transform decoder configured to decode a current frame of the second subset by constructing spectral information for the current frame of the second subset from the encoded bitstream and performing a spectral-to-time-domain transformation onto the spectral information to acquire a time-domain signal such that a level of the time-domain signal depends on the global gain value.

According to another embodiment, a CELP decoder may have: an excitation generator configured to generate a current excitation for a current frame of a bitstream by constructing an adaptive codebook excitation based on a past excitation and an adaptive codebook index for the current frame within the bitstream; constructing an innovation codebook excitation based on an innovation codebook index for the current frame within the bitstream; computing an estimate of an energy of the innovation codebook excitation spectrally weighted by a weighted linear prediction synthesis filter constructed from linear prediction filter coefficients within the bitstream; setting a gain of the innovation codebook excitation based on a ratio between a global gain value within the bitstream and the estimated energy; and combining the adaptive codebook excitation and the innovation codebook excitation to achieve the current excitation; and a linear prediction synthesis filter configured to filter the current excitation based on the linear prediction filter coefficients.

According to another embodiment, an SBR decoder may have: a core decoder as discussed above for decoding core-coder portion of a bitstream to acquire a core band signal, the SBR decoder configured to decode envelope energies for a spectral band to be replicated, from an SBR portion of the bitstream, and scaling the envelope energies according to an energy of the core band signal.

According to another embodiment, a multi-mode audio encoder may be configured to encode an audio content into an encoded bitstream with encoding a first subset of frames in a first coding mode and a second subset of frames in a second coding mode, wherein the second subset of frames is respectively composed of one or more sub-frames, wherein the multi-mode audio encoder is configured to determine and encode a global gain value per frame, and determine and encode, per sub-frames of at least a subset of the sub-frames of the second subset, a corresponding bitstream element differentially to the global gain value of the respective frame, wherein the multi-mode audio encoder is configured such that a change of the global gain value of the frames within the encoded bitstream results in an adjustment of an output level of a decoded representation of the audio content at the decoding side.

According to another embodiment, a multi-mode audio encoder for encoding an audio content into an encoded bitstream by CELP encoding a first subset of frames of the audio content and transform encoding a second subset of the frames may have: a CELP encoder configured to encode a current frame of the first subset, which CELP encoder may have: a linear prediction analyzer configured to generate linear prediction filter coefficients for the current frame of the first subset and encode same into the encoded bitstream; and an excitation generator configured to determine a current excitation of the current frame of the first subset, which, when filtered by a linear prediction synthesis filter based on the linear prediction filter coefficients within the encoded bitstream, recovers the current frame of the first subset, defined by a past excitation and a codebook index for the current frame of the first subset and encoding the codebook index into the encoded bitstream; and a transform encoder configured to encode a current frame of the second subset by performing a time-to-spectral-domain transformation onto a time-domain signal for the current frame of the second subset to acquire spectral information and encode the spectral information into the encoded bitstream, wherein the multi-mode audio encoder is configured to encode a global gain value into the encoded bitstream, the global gain value depending on an energy of a version of the audio content of the current frame of the first subset, filtered with the linear prediction analysis filter depending on the linear prediction coefficients, or an energy of the time-domain signal.

According to another embodiment, a CELP encoder may have: a linear prediction analyzer configured to generate linear prediction filter coefficients for a current frame of an audio content and encode the linear prediction filter coefficients into a bitstream; an excitation generator configured to determine a current excitation of the current frame as a combination of an adaptive codebook excitation and an innovation codebook excitation, which, when filtered by a linear prediction synthesis filter based on the linear prediction filter coefficients, recovers the current frame, by constructing the adaptive codebook excitation defined by a past excitation and an adaptive codebook index for the current frame and encoding the adaptive codebook index into the bitstream; and constructing the innovation codebook excitation defined by an innovation codebook index for the current frame and encoding the innovation codebook index into the bitstream; and an energy determiner configured to determine an energy of a version of the audio content of the current frame filtered a weighting filter, to acquire a global gain value and encoding the global gain value into the bitstream, the weighting filter construed from the linear prediction filter coefficients.

According to another embodiment, a multi-mode audio decoding method for providing a decoded representation of audio content on the basis of an encoded bitstream may have the steps of: decoding a global gain value per frame of the encoded bitstream, wherein a first subset of the frames being coded in a first coding mode and a second subset of the frames being coded in a second coding mode, with each frame of the second subset being composed of more than one sub-frames, decoding, per sub-frame of at least a subset of the sub-frames of the second subset of frames, a corresponding bitstream element differentially to the global gain value of the respective frame, and completing decoding the bitstream using the global gain value and the corresponding bitstream element in decoding the sub-frames of the at least subset of the sub-frames of the second subset of frames and the global gain value in decoding the first subset of frames, wherein the multi-mode audio decoding method is performed such that a change of the global gain value of the frames within the encoded bitstream results in an adjustment of an output level of the decoded representation of the audio content.

According to another embodiment, a multi-mode audio decoding method for providing a decoded representation of an audio content on the basis of an encoded bitstream, a first subset of frames of which is CELP coded and a second subset of frames of which is transform coded, may have the steps of: CELP decoding a current frame of the first subset, which CELP decoding may have the steps of: generating a current excitation of the current frame of the first subset by constructing an codebook excitation based on a past excitation and an codebook index of the current frame of the first subset within the encoded bitstream, and setting a gain of the codebook excitation based on a global gain value within the encoded bitstream; and filtering the current excitation based on linear prediction filter coefficients for the current frame of the first subset within the encoded bitstream; transform decoding a current frame of the second subset by constructing spectral information for the current frame of the second subset from the encoded bitstream and performing a spectral-to-time-domain transformation onto the spectral information to acquire a time-domain signal such that a level of the time-domain signal depends on the global gain value.

According to another embodiment, a CELP decoding method may have the steps of generating a current excitation for a current frame of a bitstream by constructing an adaptive codebook excitation based on a past excitation and an adaptive codebook index for the current frame within the bitstream; constructing an innovation codebook excitation based on an innovation codebook index for the current frame within the bitstream; computing an estimate of an energy of the innovation codebook excitation spectrally weighted by a weighted linear prediction synthesis filter constructed from linear prediction filter coefficients within the bitstream; setting a gain of the innovation codebook excitation based on a ratio between a global gain value within the bitstream and the estimated energy; and combining the adaptive codebook excitation and the innovation codebook excitation to achieve the current excitation; and filtering the current excitation based on the linear prediction filter coefficients by a linear prediction synthesis filter.

According to another embodiment, a multi-mode audio encoding method may have the step of: encoding an audio content into an encoded bitstream with encoding a first subset of frames in a first coding mode and a second subset of frames in a second coding mode, wherein the second subset of frames is respectively composed of one or more sub-frames, wherein the multi-mode audio encoding method may further have the step of: determining and encoding a global gain value per frame, and determine and encode, per sub-frames of at least a subset of the sub-frames of the second subset, a corresponding bitstream element differentially to the global gain value of the respective frame, wherein the multi-mode audio encoding method is performed such that a change of the global gain value of the frames within the encoded bitstream results in an adjustment of an output level of a decoded representation of the audio content at the decoding side.

According to another embodiment, a multi-mode audio encoding method for encoding an audio content into an encoded bitstream by CELP encoding a first subset of frames of the audio content and transform encoding a second subset of the frames, may have the steps of: encoding a current frame of the first subset, which CELP encoding may have the steps of: performing linear prediction analysis to generate linear prediction filter coefficients for the current frame of the first subset and encode same into the encoded bitstream; and determining a current excitation of the current frame of the first subset, which, when filtered by a linear prediction synthesis filter based on the linear prediction filter coefficients within the encoded bitstream, recovers the current frame of the first subset, defined by a past excitation and a codebook index for the current frame of the first subset and encoding the codebook index into the encoded bitstream; and encoding a current frame of the second subset by performing a time-to-spectral-domain transformation onto a time-domain signal for the current frame of the second subset to acquire spectral information and encode the spectral information into the encoded bitstream, wherein the multi-mode audio encoding method may further have the step of: encoding a global gain value into the encoded bitstream, the global gain value depending on an energy of a version of the audio content of the current frame of the first subset, filtered with the linear prediction analysis filter depending on the linear prediction coefficients, or an energy of the time-domain signal.

According to another embodiment, a CELP encoding method may have the steps of: performing linear prediction analysis to generate linear prediction filter coefficients for a current frame of an audio content and encode the linear prediction filter coefficients into a bitstream; determining a current excitation of the current frame as a combination of an adaptive codebook excitation and an innovation codebook excitation, which, when filtered by a linear prediction synthesis filter based on the linear prediction filter coefficients, recovers the current frame, by constructing the adaptive codebook excitation defined by a past excitation and an adaptive codebook index for the current frame and encoding the adaptive codebook index into the bitstream; and constructing the innovation codebook excitation defined by an innovation codebook index for the current frame and encoding the innovation codebook index into the bitstream; and determining an energy of a version of the audio content of the current frame filtered a weighting filter, to acquire a global gain value and encoding the global gain value into the bitstream, the weighting filter construed from the linear prediction filter coefficients.

Another embodiment may have a computer program including a program code for performing, when running on a computer, a method as discussed above.

In accordance with a first aspect of the present invention, the inventors of the present application realized that one problem encountered when trying to harmonize the global gain adjustment across different coding modes stems from the fact that different coding modes have different frame sizes and are differently decomposed into sub-frames. According to the first aspect of the present application, this difficulty is overcome be encoding bitstream elements of sub-frames differentially to the global gain value so that a change of the global gain value of the frames results in an adjustment of an output level of the decoded representation of the audio content. Concurrently, the differential coding saves bits otherwise occurring when introducing a new syntax element into an encoded bitstream. Even further, the differential coding enables the lowering of the burden of globally adjusting the gain of an encoded bitstream by allowing the time resolution in setting the global gain value to be lower than the time resolution at which the aforementioned bitstream element differentially encoded to the global gain value adjusts the gain of the respective sub-frame.

Accordingly, in accordance with a first aspect of the present application, a multi-mode audio decoder for providing a decoder representation of an audio content on the basis of an encoded bitstream is configured to decode a global gain value per frame of the encoded bitstream, a first subset of the frames being coded in a first coding mode and a second subset of frames being coded in a second coding mode, with each frame of the second subset being composed of more than one sub-frames, decode, per sub-frame of at least a subset of the sub-frames of the second subset of frames, a corresponding bitstream element differential to the global gain value of the respective frame, and complete decoding the bitstream using the global gain value and the corresponding bitstream element and decoding the sub-frames of the at least subset of the sub-frames of the second subset of the frames and the global gain value in decoding the first subset of frames, wherein the multi-code audio decoder is configured such that a change of the global gain value of the frames within the encoded bitstream results in an adjustment of an output level of the decoder representation of the audio content. A multi-mode audio encoder is, in accordance with this first aspect, configured to encode an audio content into an encoded bitstream with an encoding a first subset of sub-frames in a first coding mode and a second subset of frames in the second coding mode, when the second subset of frames are composed of one or more sub-frames, when the multi-mode audio encoder is configured to determine and encode a global gain value per frame, and determine and encode, the sub-frames of at least a subset of the sub-frames of the second subset, a corresponding bitstream element differential to the global gain value of the respective frame, wherein the multi-mode audio encoder is configured such that a change of the global gain value of the frames within the encoded bitstream results in an adjustment of an output level of a decoded representation of the audio content at the decoding side.

In accordance with a second aspect of the present application, the inventors of the present application discovered that a global gain control across CELP coded frames and transform coded frames may be achieved by maintaining the above-outlined advantages, if the gain of the codebook excitation of the CELP codec is co-controlled along with a level of the transform or inverse transform of the transform coded frames. Of course, such co-use may be performed via differential coding.

Accordingly, a multi-mode audio decoder for providing a decoded representation of an audio content on the basis of an encoded bitstream, a first subset of frames of which is CELP coded and a second subset of frames of which are transform coded, comprises, according to the second aspect, a CELP decoder configured to decode a current frame of the first subset, the CELP decoder comprising an excitation generator configured to generate a current excitation of a current frame of the first subset by constructing a codebook excitation, based on a past excitation and codebook index of the current frame of the first subset within the encoded bitstream, and setting a gain of the codebook excitation based on the global gain value within the encoded bitstream; and a linear prediction synthesis filter configured to filter the current excitation based on linear prediction filter coefficients for the current frame of the first subset within the encoded bitstream, and a transform decoder configured to decode a current frame of the second subset by constructing spectral information for the current frame of the second subset from the encoded bitstream and forming a spectral-to-time-domain transformation onto the spectral transformation to obtain a time-domain signal such that a level of the time-domain signal depends on the global gain value.

Likewise, a multi-mode audio encoder for encoding an audio content into an encoded stream by CELP encoding a first subset of frames of the audio content and transform encoding a second subset of frames comprises, according to the second aspect, a CELP encoder configured to encode the current frame of the first subset, the CELP encoder comprising a linear prediction analyzer configured to generate linear prediction filter coefficients for the current frame of the first subset and encode same into the encoded bitstream, and an excitation generator configured to determine a current excitation of the current frame of the first subset which, when filtered by a linear prediction synthesis filter based on the linear prediction filter coefficients within the encoded bitstream recovers the current frame of the first subset, by constructing the codebook excitation based on a past excitation and a codebook index for the current frame of the first subset, and a transform encoded configured to encode a current frame of the second subset by performing a time-to-spectral-domain transformation onto a time-domain signal for the current frame for the second subset to obtain spectral information and encode the spectral information into the encoded bitstream, wherein the multi-mode audio encoder is configured to encode a global gain value into the encoded bitstream, the global gain value depending on an energy of a version of the audio content of the current frame of the first subset filtered with a linear prediction analysis filter depending on the linear prediction coefficients, or an energy of the time-domain signal.

According to a third aspect of the present application, the present inventors found out that the variation of the loudness of a CELP coded bitstream upon changing the respective global gain value is better adapted to the behavior of transform coded level adjustments, if the global gain value in CELP coding is computed and applied in the weighted domain of the excitation signal, rather than the plain excitation signal directly. Besides, computation and appliance of the global gain value in the weighted domain of the excitation signal is also an advantage when considering the CELP coding mode exclusively as the other gains in CELP such as code gain and LTP gain, are computed in the weighted domain, too.

Accordingly, according to the third aspect, a CELP decoder comprises an excitation generator configured to generate a current excitation for a current frame of a bitstream by constructing an adaptive codebook excitation based on a past excitation and an adaptive codebook index for the current frame within the bitstream, constructing an innovation codebook excitation based on an innovation codebook index for the current frame within the bitstream, computing an estimate of an energy of the innovation codebook excitation spectrally weighted by a weighted linear prediction synthesis filter constructed from linear prediction coefficients within the bitstream, setting a gain of the innovation codebook excitation based on a ratio between a gain value within the bitstream the estimated energy, and combining the adaptive codebook excitation and the innovation codebook excitation to obtain the current excitation; and a linear prediction synthesis filter configured to filter the current excitation based on the linear prediction filter coefficients.

Likewise, a CELP encoder comprises, according to the third aspect, a linear prediction analyzer configured to generate linear prediction filter coefficients for a current frame of an audio content and encode linear prediction filter coefficient into a bitstream; an excitation generator configured to determine a current excitation of the current frame as a combination of an adaptive codebook excitation and an innovation codebook excitation which, when filtered by a linear prediction synthesis filter based on the linear prediction filter coefficients, recovers the current frame, by constructing the adaptive codebook excitation defined by a past excitation and an adaptive codebook index for the current frame and encoding the adaptive codebook index into the bitstream, and constructing the innovation codebook excitation defined by an innovation codebook index for the current frame and encoding the innovation codebook index into the bitstream; and an energy determiner configured to determine an energy of a version of an audio content of the current frame filtered with a linear prediction synthesis filter depending on the linear prediction filter coefficients and a perceptual weighting filter to obtain a gain value and an encoding the gain value into the bitstream, the weighting filter construed from the linear prediction filter coefficients.

BRIEF DESCRIPTION OF THE DRAWINGS

Advantageous embodiments of the present application are the subject of the dependent claims attached herewith.

Moreover, advantageous embodiments of the present application are described in the following with respect to the figures, among which.

DETAILED DESCRIPTION OF THE INVENTION

Figure 1A:
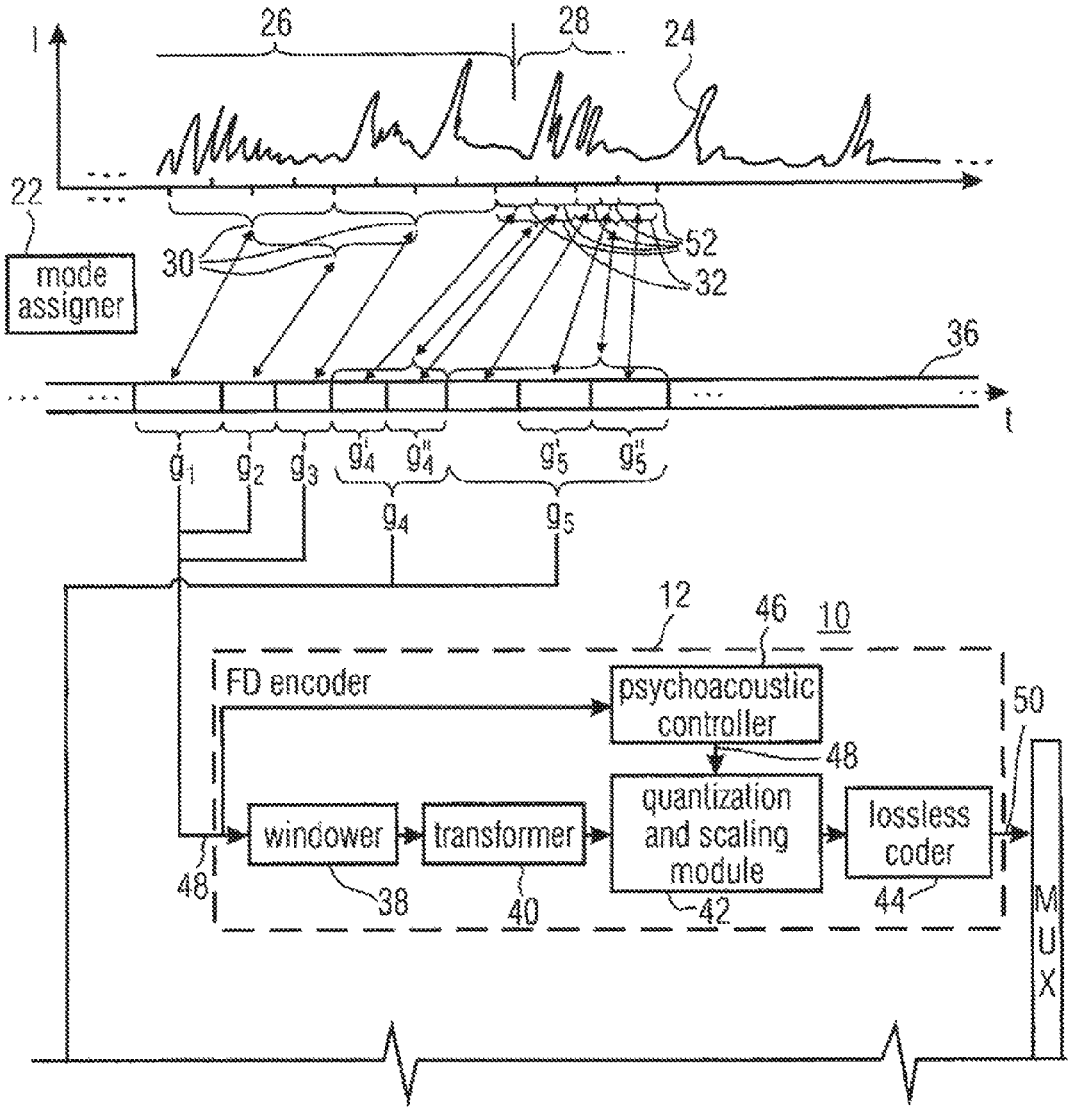
FIGS. 1*a* and 1*b* shows a block diagram of a multi-mode audio encoder according to an embodiment.
Figure 1B:
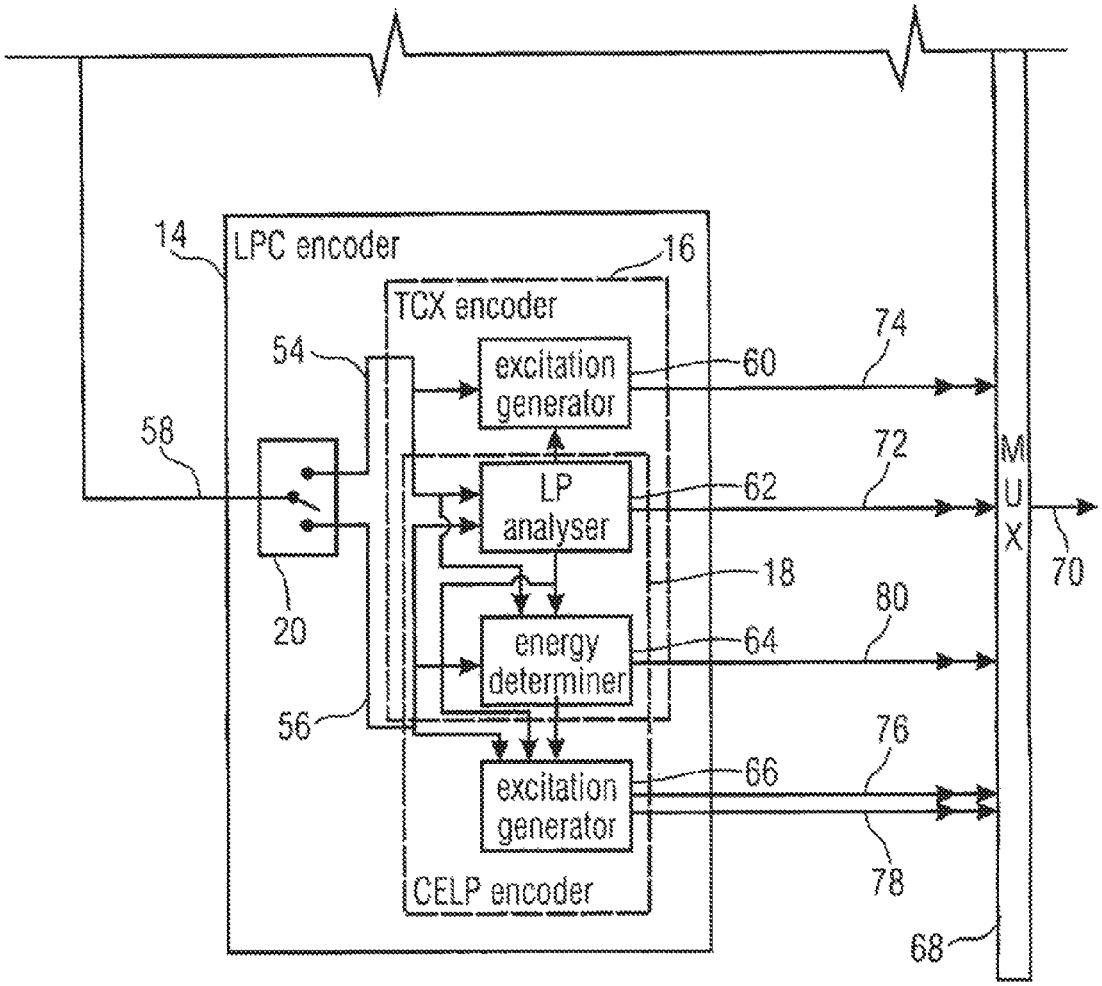

FIG. 1 shows an embodiment of a multi-mode audio encoder according to an embodiment of the present application. The multi-mode audio encoder of FIG. 1 is suitable for encoding audio signals of a mixed type such as of a mixture of speech and music, or the like. In order to obtain an optimum rate/distortion compromise, the multi-mode audio encoder is configured to switch between several coding modes in order to adapt the coding properties to the current needs of the audio content to be encoded. In particular, in accordance with the embodiment of FIG. 1, the multi-mode audio encoder generally uses three different coding modes, namely FD (frequency-domain) coding, and LP (linear prediction) coding, which in turn, is divided up into TCX (transform coded excitation) and CELP (codebook excitation linear prediction) coding. In FD coding mode, the audio content to be encoded is windowed, spectrally decomposed, and the spectral decomposition is quantized and scaled according to psychoacoustics in order to hide the quantization noise beneath the masking threshold. In TCX and CELP coding modes, the audio content is subject to linear prediction analysis in order to obtain linear prediction coefficients, and these linear prediction coefficients are transmitted within the bitstream along with an excitation signal which, when filtered with a corresponding linear prediction synthesis filter using the linear prediction coefficients within the bitstream yields the decoded representation of the audio content. In the case of TCX, the excitation signal is transform coded, whereas in the case of CELP, the excitation signal is coded by indexing entries within a codebook or otherwise synthetically constructing a codebook vector of samples of be filtered. In ACELP (algebraic codebook excitation linear prediction), which is used in accordance with the present embodiment, the excitation is composed of an adaptive codebook excitation and an innovation codebook excitation. As will be outlined in more detail below, in TCX, the linear prediction coefficients may be exploited at the decoder side also directly in the frequency domain for shaping the noise quantization by deducing scale factors. In this case, TCX is set to transform the original signal and apply the result of the LPC only in the frequency domain.

Despite different coding modes, the encoder of FIG. 1 generates the bitstream such that a certain syntax element associated with all frames of the encoded bitstream—with instantiations being associated with the frames individually or in groups of frames—, allows a global gain adaptation across all coding modes by, for example, increasing or decreasing these global values by the same amount such as by the same number of digits (which equals a scaling with a factor (or divisor) of the logarithmic base times the number of digits).

In particular, in accordance with the various coding modes supported by the multi-mode audio encoder 10 of FIG. 1, same comprises an FD encoder 12 and an LPC (linear prediction coding) encoder 14. The LPC encoder 14, in turn, is composed of a TCX encoding portion 16, a CELP encoding portion 18, and a coding mode switch 20. A further coding mode switch comprised by encoder 10 is rather generally illustrated at 22 as mode assigner. The mode assigner is configured to analyze the audio content 24 to be encoded in order to associate consecutive time portions thereof to different coding modes. In particular, in the case of FIG. 1, the mode designer 22 assigns different consecutive time portions of the audio content 24 to either one of FD coding mode and LPC coding mode. In the illustrative example of FIG. 1, for example, mode assigner 22 has assigned portion 26 of audio content 24 to FD coding mode, whereas the immediately following portion 28 is assigned to LPC coding mode. Depending on the coding mode assigned by the mode assigner 22, the audio content 24 may be subdivided into consecutive frames differently. For example, in the embodiment of FIG. 1, the audio content 24 within portion 26 is encoded in frames 30 of equal length and with an overlap of each other of, for example, 50%. In other words, the FD encoder 12 is configured to encode FD portion 26 of the audio content 24 in these units 30. In accordance with the embodiment of FIG. 1, the LPC encoder 14 is also configured to encode its associated portion 28 of the audio content 24 in units of frames 32 with these frames, however, not necessarily having the same size as frames 30. In the case of FIG. 1, for example, the size of the frames 32 is smaller than the size of frames 30. In particular, in accordance with a specific embodiment, the length of frames 30 is 2048 samples of the audio content 24, whereas the length of frames 32 is 1024 samples each. It could be possible that the last frame overlaps the first frame at a border between LPC coding mode and FD coding mode. However, in the embodiment of FIG. 1, and as exemplarily shown in FIG. 1, it may also be possible that there is no frame overlap in the case of transitions from FD coding mode to LPC coding mode, and vice-a-versa.

As indicated in FIG. 1, the FD encoder 12 receives frames 30 and encodes them by frequency-domain transform coding into respective frames 34 of the encoded bitstream 36. To this end, FD encoder 12 comprises a windower 38, a transformer 40, a quantization and scaling module 42, and a lossless coder 44, as well as a psychoacoustic controller 46. In principle, FD encoder 12 may be implemented according to the AAC standard as far as the following description does not teach a different behavior of the FD encoder 12. In particular, windower 38, transformer 40, quantization and scaling module 42 and lossless coder 44, are serially connected between an input 48 and an output 50 of FD encoder 12 and psychoacoustic controller 46 has an input connected to input 48 and an output connected to a further input of quantization and scaling module 42. It should be noted that FD encoder 12 may comprise further modules for further coding options which are, however, not critical here.

Windower 38 may use different windows for windowing a current frame entering input 48. The windowed frame is subject to a time-to-spectral-domain transformation in transformer 40, such as using an MDCT or the like. Transformer 40 may use different transform lengths in order to transform the windowed frames.

In particular, windower 38 may support windows the length of which coincide with the length of frames 30 with transformer 40 using the same transform length in order to yield a number of transform coefficients which may, for example, in case of MDCT, correspond to half the number of samples of frame 30. Windower 38 may, however, also be configured to support coding options according to which several shorter windows such as eight windows of half the length of frames 30 which are offset relative to each other in time, are applied to a current frame with transformer 40 transforming these windowed versions of the current frame using a transform length complying with the windowing, thereby yielding eight spectra for that frame sampling the audio content at different times during that frame. The windows used by windower 38 may be the symmetric or asymmetric and may have a zero leading end and/or zero rear end. In case of applying several short windows to a current frame, the non-zero portion of these short windows is displaced relative to each other, however, overlapping each other. Of course, other coding options for the windows and transform lengths for windower 38 and transformer 40 may be used in accordance with an alternative embodiment.

The transform coefficients output by transformer 40 are quantized and scaled in module 42. In particular, psychoacoustic controller 46 analyzes the input signal at input 48 in order to determine a masking threshold 48 according to which the quantization noise introduced by quantization and scaling is formed to be below the masking threshold. In particular, scaling module 42 may operate in scale factor bands together covering the spectral domain of transformer 40 into which the spectral domain is subdivided. Accordingly, groups of consecutive transform coefficients are assigned to different scale factor bands. Module 42 determines a scale factor per scale factor band, which when multiplied by the respective transform coefficient values assigned to the respective scale factor bands, yields the reconstructed version of the transform coefficients output by transformer 40. Besides this, module 42 sets a gain value spectrally uniformly scaling the spectrum. A reconstructed transform coefficient, thus, is equal to the transform coefficient value times the associated scale factor times the gain value $g_i$ of the respective frame i. Transform coefficient values, scale factors and gain value are subject to lossless coding in lossless coder 44, such as by way of entropy coding such as arithmetic or Huffman coding, along with other syntax elements concerning, for example, the window and transform length decisions mentioned before and further syntax elements enabling further coding options. For further details in this regard, reference is made to the AAC standard in respect of further coding options.

To be slightly more precise, quantization and scaling module 42 may be configured to transmit a quantized transform coefficient value per spectral line k, which yields, when rescaled, the reconstructed transform coefficient at the respective spectral line k, namely x_rescal, when multiplied with $$gain=2^{0,25\cdot(sf-sf_offset)}$$

wherein sf is the scale factor of the respective scale-factor band to which the respective quantized transform coefficient belongs, and sf offset is a constant which may be set, for example, to 100.

Thus, the scale factors are defined in the logarithm domain. The scale factors may be coded within the bitstream 36 differentially to each other along the spectral access, i.e. merely the difference between spectrally neighboring scale factors sf may be transmitted within the bitstream. The first scale factor sf may be transmitted within the bitstream differentially coded relative to the afore-mentioned global_gain value. This syntax element global_gain will be of interest in the following description.

The global_gain value may be transmitted within the bitstream in the logarithmic domain. That is, module 42 might be configured to take a first scale factor sf of a current spectrum, as the global_gain. This sf value may, then, transmitted differentially with a zero and the following sf values differentially to the respective predecessor.

Obviously, changing global_gain changes the energy of the reconstructed transform, and thus translates into a loudness change of the FD coded portion 26, when uniformly conducted on all frames 30.

In particular, global_gain of FD frames is transmitted within the bitstream such that global_gain logarithmically depends on the running mean of the reconstructed audio time samples, or, vice versa, the running mean of the reconstructed audio time samples exponentially depends on global_gain.

Similar to frames 30, all frames assigned to the LPC coding mode, namely frames 32, enter LPC encoder 14. Within LPC encoder 14, switch 20 subdivides each frame 32 into one or more sub-frames 52. Each of these sub-frames 52 may be assigned to TCX coding mode or CELP coding mode. Sub-frames 52 assigned to TCX coding mode are forwarded to an input 54 of TCX encoder 16, whereas sub-frames associated with CELP coding mode are forwarded by switch 20 to an input 56 of CELP encoder 18.

It should be noted that the arrangement of switch 20 between input 58 of LPC encoder 14 and the inputs 54 and 56 of TCX encoder 16 and CELP encoder 18, respectively, is shown in FIG. 1 merely for illustration purposes and that, in fact, the coding decision regarding the subdivision of frames 32 into sub-frames 52 with associating respective coding modes among TCX and CELP to the individual sub-frames may be done in an interactive manner between the internal elements of TCX encoder 16 and CELP encoder 18 in order to maximize a certain weight/distortion measure.

In any case, TCX encoder 16 comprises an excitation generator 60, an LP analyzer 62 and an energy determiner 64, wherein the LP analyzer 62 and the energy determiner 64 are co-used (and co-owned) by CELP encoder 18 which further comprises an own excitation generator 66. Respective inputs of excitation generator 60, LP analyzer 62 and energy determiner 64 are connected to the input 54 of TCX encoder 16. Likewise, respective inputs of LP analyzer 62, energy determiner 64 and excitation generator 66 are connected to the input 56 of CELP encoder 18. The LP analyzer 62 is configured to analyze the audio content within the current frame, i.e. TCX frame or CELP frame, in order to determine linear prediction coefficients, and is connected to respective coefficient inputs of excitation generator 60, energy determiner 64 and excitation generator 66 in order to forward the linear prediction coefficients to these elements. As will be described in more detail below, the LP analyzer may operate on a pre-emphasized version of the original audio content, and the respective pre-emphasis filter may be part of a respective input portion of the LP analyzer, or may be connected in front of the input thereof. The same applies to the energy determiner 66 as will be described in more detail below. As far as the excitation generator 60 is concerned, however, same may operate on the original signal directly. Respective outputs of excitation generator 60, LP analyzer 62, energy determiner 64, and excitation generator 66, as well as output 50, are connected to respective inputs of a multiplexer 68 of encoder 10 which is configured to multiplex the syntax elements received into bitstream 36 at output 70.

As already noted above, LPC analyzer 62 is configured to determine linear prediction coefficients for the incoming LPC frames 32. For further details regarding a possible functionality of LP analyzer 62, reference is made to the ACELP standard. Generally, LP analyzer 62 may use an auto-correlation or co-variance method in order to determine the LPC coefficients. For example, using an auto-correlation method, LP analyzer 62 may produce an auto-correlation matrix with solving the LPC coefficients using a Levinson-Durban algorithm. As known in the art, the LPC coefficients define a synthesis filter which roughly models the human vocal tract, and when driven by an excitation signal, essentially models the flow of air through the vocal chords. This synthesis filter is modeled using linear prediction by LP analyzer 62. The rate at which the shape of vocal tracks change is limited, and accordingly, the LP analyzer 62 may use an update rate adapted to the limitation and different from the frame-rate of frames 32 for updating the linear prediction coefficients. The LP analysis performed by analyzer 62 provides information on certain filters for elements 60, 64 and 66, such as:

the linear prediction synthesis filter H(z);

the inverse filter thereof, namely the linear prediction analysis filter or whitening filter $$A(z) \text{ with } H(z) = \frac{1}{A(z)}.$$

a perceptual weighting filter such as $W(z)=A(z/\lambda)$, wherein $\lambda$ is a weighting factor LP analyzer 62 transmits information on the LPC coefficients to multiplexer 68 for being inserted into bitstream 36. This information 72 may represent the quantized linear prediction coefficients in an appropriate domain such as a spectral pair domain, or the like. Even the quantization of the linear prediction coefficients may be performed in this domain. Further, LPC analyzer 62 may transmit the LPC coefficients or the information 72 thereon, at a rate greater than a rate at which the LPC coefficients are actually reconstructed at the decoding side. The latter update rate is achieved, for example, by interpolation between the LPC transmission times. Obviously, the decoder only has access to the quantized LPC coefficients, and accordingly, the afore-mentioned filters defined by the corresponding reconstructed linear predictions are denoted by $\hat{H}(z)$, $\hat{A}(z)$ and $\hat{W}(z)$.

As already outlined above, the LP analyzer 62 defines an LP synthesis filter H(z) and $\hat{H}(z)$, respectively, which, when applied to a respective excitation, recovers or reconstructs the original audio content besides some post-processing, which however, is not considered here for ease of explanation.

Excitation generators 60 and 66 are for defining this excitation and transmitting respective information thereon to the decoding side via multiplexers 68 and bitstream 36, respectively. As far as excitation generator 60 of TCX encoder 16 is concerned, same codes the current excitation by subjecting a suitable excitation found, for example, by some optimization scheme to a time-to-spectral-domain transformation in order to yield a spectral version of the excitation, wherein this spectral version of spectral information 74 is forwarded to the multiplexer 68 for insertion into the bitstream 36, with the spectral information being quantized and scaled, for example, analogously to the spectrum on which module 42 of FD encoder 12 operates.

That is, spectral information 74 defining the excitation of TCX encoder 16 of the current sub-frame 52, may have quantized transform coefficients associated therewith, which are scaled in accordance with a single scale factor which, in turn, is transmitted relative to a LPC frame syntax element also called global_gain in the following. As in the case of global_gain of the FD encoder 12, global_gain of LPC encoder 14 may also be defined in the logarithmic domain. An increase of this value directly translates into a loudness increase of the decoded representation of the audio content of the respective TCX sub-frames as the decoded representation is achieved by processing the scaled transform coefficients within information 74 by linear operations preserving the gain adjustment. These linear operations are the inverse time-frequency transform and, eventually, the LP synthesis filtering. As will be explained in more detail below, however, excitation generator 60 is configured to code the just-mentioned gain of the spectral information 74 into the bitstream in a time resolution higher than in units of LPC frames. In particular, excitation generator 60 uses a syntax element called delta_global_gain in order to differentially code—differentially to the bitstream element global_gain—the actual gain used for setting the gain of the spectrum of the excitation. delta_global_gain may also be defined in the logarithm domain. The differential coding may be performed such that delta_global_gain may be defined as multiplicatively correcting the global_gain-gain in the linear domain.

In contrast to excitation generator 60, excitation generator 66 of CELP encoder 18 is configured to code the current excitation of the current sub-frame by using codebook indices. In particular, excitation generator 66 is configured to determine the current excitation by a combination of an adaptive codebook excitation and an innovation codebook excitation. Excitation generator 66 is configured to construct the adaptive codebook excitation for a current frame so as to be defined by a past excitation, i.e. the excitation used for a previously coded CELP sub-frame, for example, and an adaptive codebook index for the current frame. The excitation generator 66 encodes the adaptive codebook index 76 into the bitstream by forwarding same to multiplexer 68. Further, excitation generator 66 constructs the innovation codebook excitation defined by an innovation codebook index for the current frame and encodes the invocation codebook index 78 into the bitstream by forwarding same to multiplexer 68 for insertion into bitstream 36. In fact, both indices may be integrated into one common syntax element. Together, same enable the decoder to recover the codebook excitation thus determined by the excitation generator. In order to guarantee the synchronization of the internal states of encoder and decoder, the generator 66 not only determines the syntax elements for enabling the decoder to recover the current codebook excitation, bit same also actually updates its state by actually generating same in order to use the current codebook excitation as a starting point, i.e. the past excitation, for encoding the next CELP frame.

The excitation generator 66 may be configured to, in constructing the adaptive codebook excitation and the innovation codebook excitation, minimize a perceptual weight distortion measure, relative to the audio content of the current sub-frame considering that the resulting excitation is subject to LP synthesis filtering at the decoding side for reconstruction. In effect, the indices 76 and 78 index certain tables available at the encoder 10 as well as the decoding side in order to index or otherwise determine vectors serving as an excitation input of the LP synthesis filter. Contrary to the adaptive codebook excitation, the innovation codebook excitation is determined independent from the past excitation. In effect, excitation generator 66 may be configured to determine the adaptive codebook excitation for the current frame using the past and reconstructed excitation of the previously coded CELP sub-frame by modifying the latter using a certain delay and gain value and a predetermined (interpolation) filtering, so that the resulting adaptive codebook excitation of the current frame minimizes a difference to a certain target for the adaptive codebook excitation recovering, when filtered by the synthesis filter, the original audio content. The just-mentioned delay and gain and filtering is indicated by the adaptive codebook index. The remaining discrepancy is compensated by the innovation codebook excitation. Again, excitation generator 66 suitably sets the codebook index to find an optimum innovation codebook excitation which, when combined with (such as added to), the adaptive codebook excitation yielding the current excitation for the current frame (with then serving as the past excitation when constructing the adaptive codebook excitation of the following CELP sub-frame). In even other words, the adaptive codebook search may be performed on a sub-frame basis and consist of performing a closed-loop pitch search, then computing the adaptive codevector by interpolating the past excitation at the selected fractional pitch lag. In effect, the excitation signal u(n) is defined by excitation generator 66 as a weighted sum of the adaptive codebook vector v(n) and the innovation codebook vector c(n) by $$u(n)=\hat{g}_p v(n)+\hat{g}_c c(n).$$

The pitch gain $\hat{g}_p$ is defined by the adaptive codebook index 76. The innovation codebook gain $\hat{g}_c$ is determined by the innovative codebook index 78 and by the afore-mentioned global_gain syntax element for LPC frames determined by energy determiner 64 as will be outlined below.

That is, when optimizing the innovation codebook index 78, excitation generator 66 adopts, and remains unchanged, the innovation codebook gain $\hat{g}_c$ with merely optimizing the innovation codebook index to determine positions and signs of pulses of the innovation codebook vector, as well as the number of these pulses.

A first approach (or alternative) for setting the above-mentioned LPC frame global_gain syntax element by energy determiner 64 is described in the following with respect to FIG. 2. According to both alternatives described below, the syntax element global_gain is determined for each LPC frame 32. This syntax element then serves as a reference for the afore-mentioned delta_global_gain syntax elements of the TCX sub-frames belonging to the respective frame 32, as well as the afore-mentioned innovation codebook gain $\hat{g}_c$ which is determined by global_gain as described below.

Figure 2:
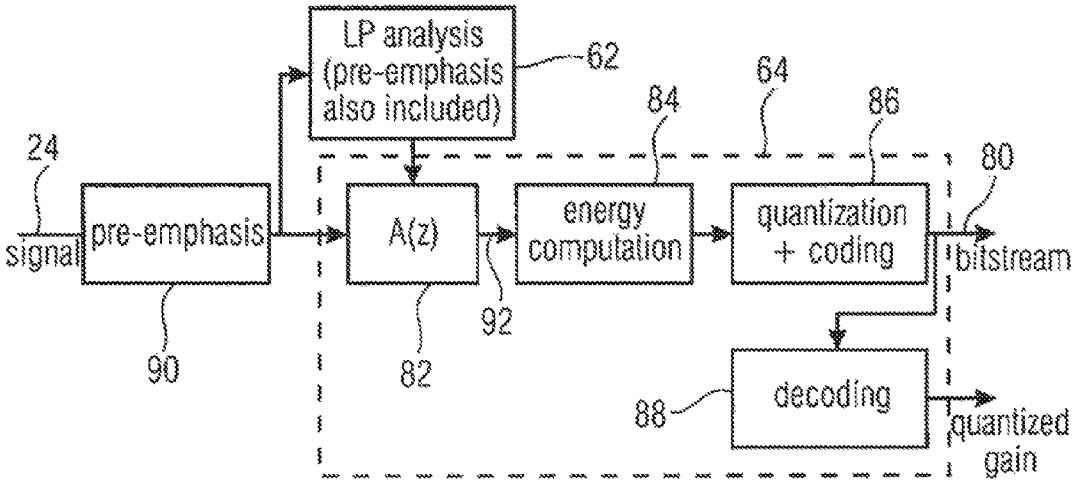
FIG. 2 shows a block diagram of the energy computation portion of the encoder of FIG. 1 in accordance with a first alternative.

As shown in FIG. 2, energy determiner 64 may be configured to determine the syntax element global_gain 80, and may comprise a linear prediction analysis filter 82 controlled by LP analyzer 62, an energy computator 84 and a quantizing and coding stage 86, as well as a decoding stage 88 for requantization. As shown in FIG. 2, a pre-emphasizer or pre-emphasis filter 90 may pre-emphasize the original audio content 24 before the latter is further processed within the energy determiner 64 as described below. Although not shown in FIG. 1, pre-emphasis filter may also be present in the block diagram of FIG. 1 directly in front of both, the inputs of LP analyzer 62 and the energy determiner 64. In other words, same may be co-owned or co-used by both. The pre-emphasis filter 90 may be given by $$H_{emph}(z)=1-\alpha z^{-1}.$$

Thus, the pre-emphasis filter may be a highpass filter. Here, it is a first order high pass filter, but more generally, same may be an $n^{th}$-order-highpass filter. In the present case, it is exemplarily a first order highpass filter, with $\alpha$ set to 0.68.

The input of energy determiner 64 of FIG. 2 is connected to the output of pre-emphasis filter 90. Between the input and the output 80 of energy determiner 64, the LP analysis filter 82, the energy computator 84, and the quantizing and coding stage 86 are serially connected in the order mentioned. The coding stage 88 has its input connected to the output of quantization and coding stage 86 and outputs the quantized gain as obtainable by the decoder.

In particular, the linear prediction analysis filter 82 A(z) applied to the pre-emphasized audio content results in an excitation signal 92. Thus, the excitation 92 equals the pre-emphasized version of the original audio content 24 filtered by the LPC analysis filter A(z), i.e. the original audio content 24 filtered with $$H_{emph}(z)\cdot A(z).$$

Based on this excitation signal 92, the common global gain for the current frame 32 is deduced by computing the energy over every 1024 samples of this excitation signal 92 within the current frame 32.

In particular, energy computator 84 averages the energy of signal 92 per segment of 64 samples in the logarithmic domain by:

$$nrg=\sum_{l=0}^{15}\frac{1}{16}\cdot\log_2\sum_{n=0}^{64}\sqrt{\frac{exc[l\cdot 64+n]*exc[l\cdot 64+n]}{64}}.$$

The gain $g_{index}$ is then quantized by quantization and coding stage 86 on 6 bits in the logarithmic domain based on mean energy nrg by:

$$g_{index}=\lfloor 4\cdot nrg+0.5\rfloor$$

This index is then transmitted within the bitstream as syntax element 80, i.e. as global gain. It is defined in the logarithmic domain. In other words, the quantization step size increases exponentially. The quantized gain is obtained by decoding stage 88 by computing:

$$\hat{g}=2^{\frac{g_{index}}{4}}.$$

The quantization used here has the same granularity as the quantization of the global gain of the FD mode, and accordingly, scaling of $g_{index}$ scales the loudness of the LPC frames 32 in the same manner as scaling of the global_gain syntax element of the FD frames 30, thereby achieving an easy way of gain control of the multi-mode encoded bitstream 36 with no need to perform a decoding and re-encoding detour, and still maintaining the quality.

As will be outlined in more detail below with regard to the decoder, for sake of the above-mentioned synchrony maintenance between encoder and decoder (excitation nupdate), the excitation generator 66 may, in optimizing or after having optimized the codebook indices, a) compute, on the basis of the global_gain, a prediction gain $g'_c$ and b) multiply the prediction gain $g'_c$ with the innovation codebook correction factory $\hat{\gamma}$ to yield the actual innovation codebook gain $\hat{g}'_c$ c) actually generate the codebook excitation by combining the adaptive codebook excitation and the innovation codebook excitation with weighting the latter with the actual innovation codebook gain $\hat{g}'_c$.

In particular, in accordance with the present alternative, quantization encoding stage 86 transmits $g_{index}$ within the bitstream and the excitation generator 66 accepts the quantized gain $\hat{g}$ as a predefined fixed reference for optimizing the innovation codebook excitation.

In particular, excitation generator 66 optimizes the innovation codebook gain $\hat{g}'_c$ using (i.e. with optimizing) only the innovation codebook index which also defines $\hat{\gamma}$ which is the innovation codebook gain correction factor. In particular, the innovation codebook gain correction factor determines the innovation codebook gain $\hat{g}_c$ to be $$\overline{E}=20\cdot\log(\hat{g})$$

$$G'_c=\hat{E}$$

$$g'_c=10^{0.05G'_c}$$

$$\hat{g}_c=\hat{\gamma}_c\cdot g'_c$$

As will be further described below, the TCX gain is coded by transmitting the element delta_global_gain coded on 5 bits:

$$\text{delta_global_gain}=\left\lfloor\left(4\cdot\log_2\left(\frac{\text{gain_tcx}}{\hat{g}}\right)+10\right)+0.5\right\rfloor$$

It is decoded as follows:

$$\text{gain_tcx}=2^{\frac{delta_global_gain-10}{4}}\cdot\hat{g}$$

Then $$g=\frac{\text{gain_tcx}}{2\cdot\text{rms}}$$

In order to complete the concordance between the gain control offered by the syntax element $g_{index}$ as far as the CELP sub-frames and the TCX sub-frames are concerned, in accordance with the first alternative described with respect to FIG. 2, the global gain $g_{index}$ is thus coded on 6 bits per frame or superframe 32. This results in the same gain granularity as for the global gain coding of the FD mode. In this case, the superframe global gain $g_{index}$ is coded only on 6 bits, although the global gain in FD mode is sent on 8 bits. Thus, the global gain element is not the same for the LPD (linear prediction domain) and FD modes. However, as the gain granularity is similar, a unified gain control can easily be applied. In particular, the logarithmic domain for coding global_gain in FD and LPD mode is advantageously performed at the same logarithmic base 2.

In order to completely harmonize both global elements, it would be straightforward to extend the coding on 8 bits even as far as the LPD frames are concerned. As far as the CELP sub-frames are concerned, the syntax element $g_{index}$ completely assumes the task of the gain control. The aforementioned delta-global-gain elements of the TCX sub-frames may be coded on 5 bits differentially from the superframe global gain. Compared to the case where the above multi-mode encoding scheme would be implemented by normal AAC, ACELP and TCX, the above concept according to the alternative of FIG. 2, would result in 2 bits less for coding in the case of a superframe 32 merely consisting of TCX 20 and/or ACELP sub-frames, and would consume 2 or 4 additional bits per superframe in case of the respective superframe comprising a TCX 40 and TCX 80 sub-frame, respectively.

In terms of signal processing, the superframe global $g_{index}$ represents the LPC residual energy averaged over the superframe 32 and quantized on a logarithmic scale. In (A)CELP, it is used instead of the "mean energy" element usually used in ACELP for estimating the innovation codebook gain. The new estimate according to the present first alternative according to FIG. 2, has more amplitude resolution than in the ACELP standard, but also less time resolution as $g_{index}$ is merely transmitted per superframe, rather than sub-frame. However, it was found out that the residual energy is a poor estimator and used as a cause indicator of the gain range. As a consequence, the time resolution is probably more important. For avoiding any problems during transients, the excitation generator 66 may be configured to systematically underestimate the innovative codebook gain and let the gain adjustment recover the gap. This strategy may counterbalance the lack of time resolution.

Further, the superframe global gain is also used in TCX as an estimation of the "global gain" element determining the scaling_gain as mentioned above. Because the superframe global gain $g_{index}$ represents the energy of the LPC residual and the TCX global represents about the energy of the weighted signal, the differential gain coding by use of delta_global_gain includes implicitly some LP gains. Nevertheless, the differential gain still shows much lower amplitude than the plane "global gain".

For 12 kbps and 24 kbps mono, some listening tests were performed focusing mainly on the quality of clean speech. The quality was found very close to the one of the current USAC differing from the above embodiment in that the normal gain control of AAC and ACELP/TCX standards has been used. However, for certain speech items, the quality tends to be slightly worse.

Figure 3:
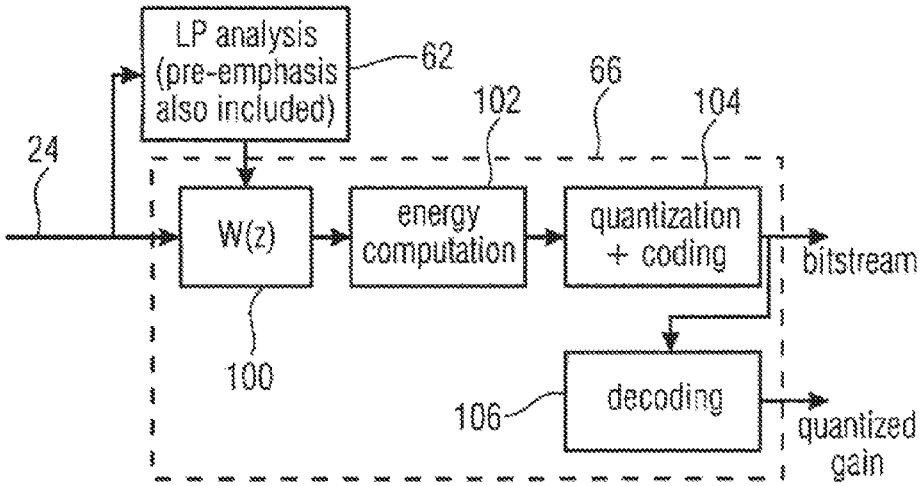
FIG. 3 shows a block diagram of the energy computation portion of the encoder of FIG. 1 in accordance with a second alternative.

After having described the embodiment of FIG. 1 according to the alternative of FIG. 2, the second alternative is described with respect to FIGS. 1 and 3. According to the second approach for the LPD mode, some drawbacks of the first alternative are solved:

- The prediction of the ACELP innovation gain failed for some subframes of high amplitude dynamic frames. It was mainly due to the energy computation which was geometrically averaged. Although, the average SNR was better than the original ACELP, the gain adjustment codebook was more often saturated. It was supposed to be the main reason of the perceived slight degradation for certain speech items.
- Furthermore, the prediction of the gain of the ACELP innovation was also not optimal. Indeed, the gain is optimized in the weighted domain whereas the gain prediction is computed in the LPC residual domain. The idea of the following alternative is to perform the prediction in the weighted domain.

The prediction of individual TCX global gains was not optimal as the transmitted energy was computed for the LPC residual while TCX computes its gain in the weighted domain.

The main difference from the previous scheme is that the global gain represents now the energy of the weighted signal instead of the energy of the excitation.

In term of bitstream, the modifications compared to the first approach are the following:

A global gain coded on 8 bits with the same quantizer as in the FD mode. Now, both LPD and FD modes share the same bitstream element. It turned out that the global gain in AAC has good reasons to be coded on 8 bits with such a quantizer. 8 bits is definitively too much for the LPD mode global gain, which can be coded only on 6 bits. However, it is the price to pay for the unification.

Code the individual global gains of TCX with a differential coding, using:

1 bit for TCX1024, fixed length codes.

4 bits on average for TCX256 and TCX 512, variable length codes (Huffman)

In term of bit consumption, the second approach differs from the first one in that:

For ACELP: same bit consumption as before

For TCX1024: +2 bits

For TCX512: +2 bits on average

For TCX256: same average bit consumption as before

In terms of quality, the second approach differs from the first one in that:

TCX audio portions should sound the same as the overall quantization granularity was kept unchanged.

ACELP audio portions could be expected to be slightly improved as the prediction was enhanced. Collected statistics show less outliers in the gain adjustment than in the current ACELP.

See, for example, FIG. 3. FIG. 3 shows the excitation generator 66 as comprising a weighting filter W(z) 100, followed by an energy computator 102 and a quantization and coding stage 104, as well as a decoding stage 106. In effect, these elements are arranged with respect to each other as the elements 82 and 88 were in FIG. 2.

The weighting filter is defined as:

$$W(z)=A(z/\gamma)$$

wherein λ is a perceptual weighting factor which may be set to 0.92.

Thus, in accordance with the second approach, the global gain common for TCX and CELP sub-frames 52 is deduced from an energy calculation performed every 2024 samples on the weighted signal, i.e. in units of the LPC frames 32. The weighted signal is computed at the encoder within filter 100 by filtering the original signal 24 by the weighting filter W(z) deduced from the LPC coefficients as output by the LP analyzer 62. By the way, the afore-mentioned pre-emphasis is not part of W(z). It is only used before computing the LPC coefficients, i.e. within or in front of LP analyser 62, and before ACELP, i.e. within or in front of excitation generator 66. In a way the pre-emphasis is already reflected in the coefficients of A(z).

Energy computator 102 then determines the energy to be:

$$nrg = \sum_{n=0}^{1023} w[n]^* w[n].$$

Quantization and coding stage 104 then quantizes the gain global_gain on 8 bits in the logarithmic domain based on the mean energy nrg by:

$$\text{global_gain} = \left\lfloor 4 \cdot \log_2\left(\sqrt{\frac{nrg}{1024}}\right) + 0.5 \right\rfloor.$$

The quantized global gain is then obtained by the decoding stage 106 by:

$$\hat{g} = 2^{\frac{global_gain}{4}}.$$

As will be outlined in more detail below with regard to the decoder, for sake of the above-mentioned synchrony maintenance between encoder and decoder (excitation nupdate), the excitation generator 66 may, in optimizing or after having optimized the codebook indices, a) estimate the innovation codebook excitation energy as determined by a first information contained within the—provisional candidate or finally transmitted—innovation codebook index, namely the above-mentioned number, positions and signs of the innovation codebook vector pulses, with filtering the respective innovation codebook vector with the LP synthesis filter, weighted however, with the weighting filter W(z) and the de-emphasis filter, i.e. the inverse of the emphasis filter, (filter H2(z), see below), and determining the energy of the result, b) form a ratio between the energy thus derived and an energy $\bar{E}=20\cdot\log(\hat{g})$ determined by the global_gain in order to obtain a prediction gain $g'_c$ c) multiply the prediction gain $g'_c$ with the innovation codebook correction factory $\hat{\gamma}$ to yield the actual innovation codebook gain $\hat{g}_c$ d) actually generate the codebook excitation by combining the adaptive codebook excitation and the innovation codebook excitation with weighting the latter with the actual innovation codebook gain $\hat{g}_c$.

In particular, the quantization thus achieved has the same granularity as the quantization of the global gain of the FD mode. Again, the excitation generator 66 may adopt, and treat as a constant, the quantized global gain $\hat{g}$ in optimizing the innovation codebook excitation. In particular, the excitation generator 66 may set the innovation codebook excitation correction factor $\hat{\gamma}$ by finding the optimum innovation codebook index so that the optimum quantized fixed-codebook gain results, namely according to:

$$\hat{g}_c=\hat{\gamma}\cdot g'_c,$$

with obeying:

$$g'_c = 10^{0.05G'_c}$$

$$G'_c = \bar{E} - E_i - 12$$

$$\bar{E} = 20\cdot\log(\hat{g})$$

-continued $$Ei = 10 \cdot \log\left(\frac{1}{64}\sum_{n=0}^{63} c_w^2[n]\right),$$

wherein $c_w$ is the innovation is the innovation vector c[n] in the weighted domain obtained by a convolution from n=0 to 63 according to:

$$c_w[n]=c[n]*h2[n],$$

wherein h2 is the impulse response of the weighted synthesis filter $$H2(z) = \frac{\hat{W}(z)}{\hat{A}(z)} H_{de_emph}(z) = \frac{\hat{A}(z/0.92)}{\hat{A}(z)\cdot(1-0.68z^{-1})}.$$

with $\gamma$=0.92 and $\alpha$=0.68, for example.

The TCX gain is coded by transmitting the element delta_global_gain coded with Variable Length Codes.

If the TCX has a size of 1024 only 1 bits is used for the delta_global_gain element, while global_gain is recalculated and requantized:

$$\text{global_gain} = \lfloor 4 \cdot \log_2(\text{gain_tcx}) + 0.5 \rfloor$$

$$\hat{g} = 2^{\frac{g_{index}}{4}}$$

$$\text{delta_global_gain} = \left\lfloor 8 \cdot \log_2\left(\frac{\text{gain_tcx}}{\hat{g}}\right) + 0.5 \right\rfloor$$

It is decoded as follows:

$$\text{gain_tcx} = 2^{\frac{delta_global_gain}{8}} \cdot \hat{g}$$

Otherwise, for the other sizes of TCX, the delta_global_gain is coded as follows:

$$\text{delta_global_gain} = \left\lfloor \left(28 \cdot \log\left(\frac{\text{gain_tcx}}{\hat{g}}\right) + 64\right) + 0.5 \right\rfloor$$

The TCX gain is then decoded as follows:

$$\text{gain_tcx} = 10^{\frac{delta_global_gain-64}{28}} \cdot \hat{g}$$

delta_global_gain can be directly coded on 7 bits or by using Huffman codes, which can produce 4 bits on average.

Finally and in both cases the final gain is deduced:

$$g = \frac{\text{gain_tcx}}{2 \cdot \text{rms}}$$

In the following, a corresponding multi-mode audio decoder corresponding to the embodiment of FIG. 1 with respect to the two alternatives described with respect to FIGS. 2 and 3 is described with respect to FIG. 4.

Figure 4:
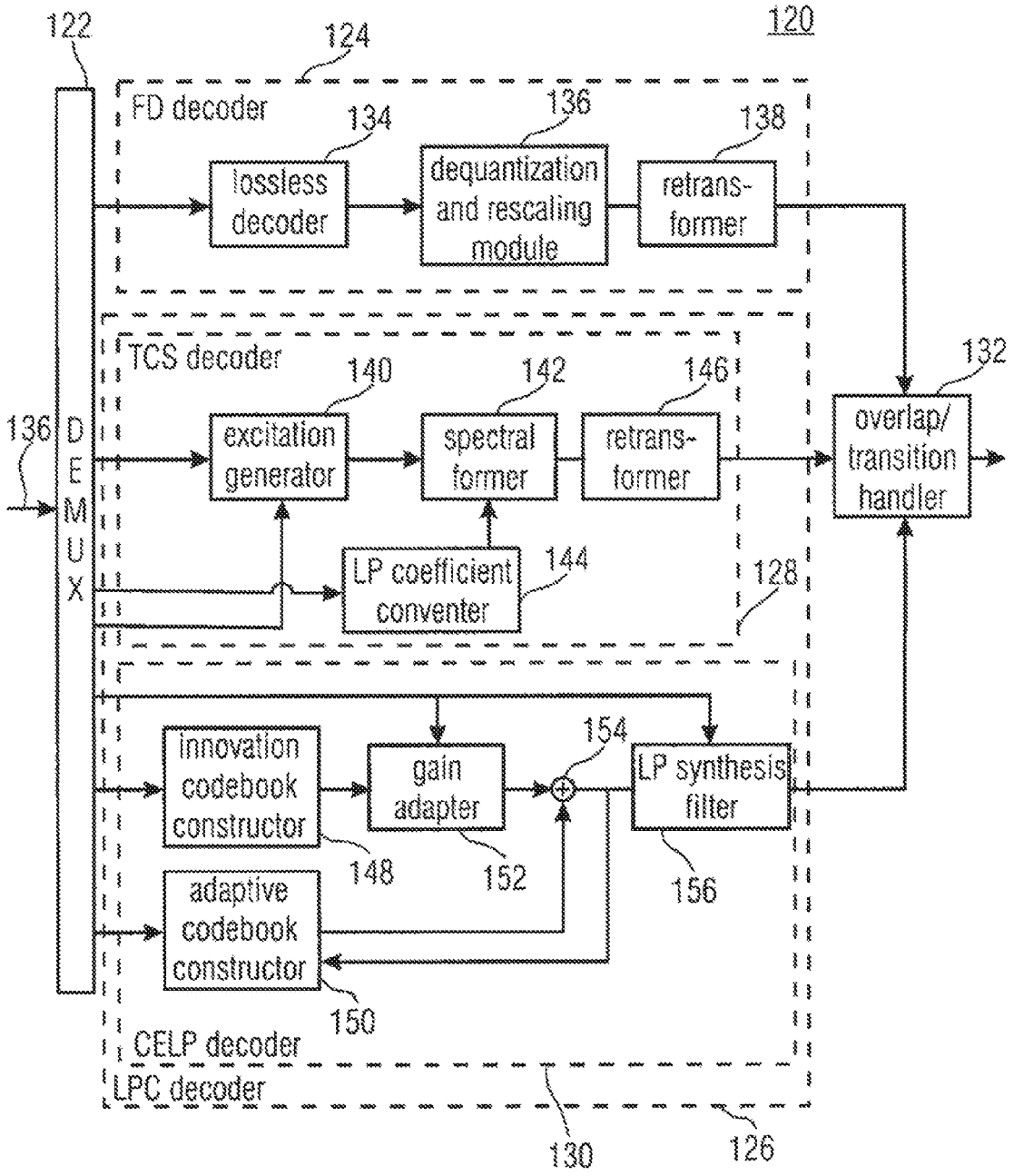
FIG. 4 shows a multi-mode audio decoder according to an embodiment and adapted to decode bitstreams encoded by the encoder of FIG. 1.

The multi-mode audio decoder of FIG. 4 is generally indicated with reference sign 120 and comprises a demultiplexer 122, an FD decoder 124, and LPC decoder 126 composed of a TCX decoder 128 and a CELP decoder 130, and an overlap/transition handler 132.

The demultiplexer comprises an input 134 concurrently forming the input of multi-mode audio decoder 120. Bitstream 36 of FIG. 1 enters input 134. Demultiplexer 122 comprises several outputs connected to decoders 124, 128, and 130, and distributes syntax elements comprised in bitstream 134 to the individual decoding machine. In effect, the multiplexer 132 distributes the frames 34 and 35 of bitstream 36 with the respective decoder 124, 128 and 130, respectively.

Each of decoders 124, 128, and 130 comprises a time-domain output connected to a respective input of overlap-transition handler 132. Overlap-transition handler 132 is responsible for performing the respective overlap/transition handling at transitions between consecutive frames. For example, overlap/transition handler 132 may perform the overlap/add procedure concerning consecutive windows of the FD frames. The same applies to TCX sub-frames. Although not described in detail with respect to FIG. 1, for example, even excitation generator 60 uses windowing followed by a time-to-spectral-domain transformation in order to obtain the transform coefficients for representing the excitation, and the windows may overlap each other. When transitioning to/from CELP sub-frames, overlap/transition handler 132 may perform special measures in order to avoid aliasing. To this end, overlap/transition handler 132 may be controlled by respective syntax elements transmitted via bitstream 36. However, as these transmission measures exceed the focus of the present application, reference is made to, for example, the ACELP W+ standard for illustrative exemplary solutions in this regard.

The FD decoder 124 comprises a lossless decoder 134, a dequantization and rescaling module 136, and a retransformer 138, which are serially connected between demultiplexer 122 and overlap/transition handler 132 in this order. The lossless decoder 134 recovers, for example, the scale factors from the bitstream which are, for example, differentially coded therein. The quantization and rescaling module 136 recovers the transform coefficients by, for example, scaling the transform coefficient values for the individual spectral lines with the corresponding scale factors of the scale factor bands to which these transform coefficient values belong. Retransformer 138 performs a spectral-to-time-domain transformation onto the thus obtained transform coefficients such an inverse MDCT, in order to obtain a time-domain signal to be forwarded to overlap/transition handler 132. Either dequantization and rescaling module 136 or retransformer 138 uses the global_gain syntax element transmitted within the bitstream for each FD frame, such that the time-domain signal resulting from the transformation is scaled by the syntax element (i.e. linearly scaled with some exponential function thereof). In effect, the scaling may be performed in advance of the spectral-to-time-domain transformation or subsequently thereto.

The TCX decoder 128 comprises an excitation generator 140, a spectral former 142, and an LP coefficient converter 144. Excitation generator 140 and spectral former 142 are serially connected between demultiplexer 122 and another input of overlap/transition handler 132, and LP coefficient converter 144 provides a further input of spectral former 142 with spectral weighting values obtained from the LPC coefficients transmitted via the bitstream. In particular, the TCX decoder 128 operates on the TCX sub-frames among sub-frames 52. Excitation generator 140 treats the incoming spectral information similar to components 134 and 136 of FD decoder 124. That is, excitation generator 140 dequantizes and rescales transform coefficient values transmitted within the bitstream in order to represent the excitation in the spectral domain. The transform coefficients thus obtained, are scaled by excitation generator 140 with a value corresponding to a sum of the syntax element delta_global_gain transmitted for the current TCX sub-frame 52 and the syntax element global_gain transmitted for the current frame 32 to which the current TCX sub-frame 52 belongs. Thus, excitation generator 140 outputs a spectral representation of the excitation for the current sub-frame scaled according to delta_global_gain and global_gain. LPC converter 134 converts the LPC coefficients transmitted within the bitstream by way of, for example, interpolation and differential coding, or the like, into spectral weighting values, namely a spectral weighting value per transform coefficient of the spectrum of the excitation output by excitation generator 140. In particular, the LP coefficient converter 144 determines these spectral weighting values such that same resemble a linear prediction synthesis filter transfer function. In other words, they resemble a transfer function of the LP synthesis filter $\hat{H}(z)$. Spectral former 140 spectrally weights the transform coefficients input by excitation generator 140 by the spectral weights obtained by LP coefficient converter 144 in order to obtain spectrally weighted transform coefficients which are then subject to a spectral-to-time-domain transformation in retransformer 146 so that retransformer 146 outputs a reconstructed version or decoded representation of the audio content of the current TCX sub-frame. However, it is noted that, as already noted above, a post-processing may be performed on the output of retransformer 146 before forwarding the time-domain signal to overlap/transition handler 132. In any case, the level of the time-domain signal output by retransformer 146 is again controlled by the global_gain syntax element of the respective LPC frame 32.

The CELP decoder 130 of FIG. 4 comprises an innovation codebook constructor 148, an adaptive codebook constructor 150, a gain adaptor 152, a combiner 154, and an LP synthesis filter 156. Innovation codebook constructor 148, gain adaptor 152, combiner 154, and LP synthesis filter 156 are serially connected between the demultiplexer 122 and the overlap/transition handler 132. Adaptive codebook constructor 150 has an input connected to the demultiplexer 122 and an output connected to a further input of combiner 154, which in turn, may be embodied as an adder as indicated in FIG. 4. A further input of adaptive codebook constructor 150 is connected to an output of adder 154 in order to obtain the past excitation therefrom. Gain adaptor 152 and LP synthesis filter 156 have LPC inputs connected to a certain output of the multiplexer 122.

After having described the structure of TCX decoder and CELP decoder, the functionality thereof is described in more detail below. The description starts with the functionality of the TCX decoder 128 first and then proceeds to the description of the functionality of the CELP decoder 130. As already described above, LPC frames 32 are subdivided into one or more sub-frames 52. Generally, CELP sub-frames 52 are restricted to having a length of 256 audio samples. TCX sub-frames 52 may have different lengths. TCX 20 or TCX 256 sub-frames 52, for instance, have a sample length of 256. Likewise, TCX 40 (TCX 512) sub-frames 52 have a length of 512 audio samples, and TCX 80 (TCX 1024) sub-frames pertain to a sample length of 1024, i.e. pertain to the whole LPC frame 32. TCX 40 sub-frames may merely be positioned at the two leading quarters of the current LPC frame 32, or the two rear quarters thereof. Thus, altogether, there are 26 different combinations of different sub-frame types into which an LPC frame 32 may be subdivided.

Thus, as just-mentioned, TCX sub-frames 52 are of different length. Considering the sample lengths just-described, namely 256, 512, and 1024, one could think that these TCX sub-frames do not overlap each other. However, this is not correct as far as the window lengths and the transform lengths measured in samples is concerned, and which is used in order to perform the spectral decomposition of the excitation. The transform lengths used by windower 38 extend, for example, beyond the leading and rear end of each current TCX sub-frame and the corresponding window used for windowing the excitation is adapted to readily extend into regions beyond the rear and leading ends of the respective current TCX sub-frame, so as to comprise non-zero portions overlapping preceding and successive sub-frames of the current sub-frame for allowing for aliasing-cancellation as known from FD coding, for example. Thus, excitation generator 140 receives quantized spectral coefficients from the bitstream and reconstructs the excitation spectrum therefrom. This spectrum is scaled depending on a combination of delta_global_gain of the current TCX sub-frame and global_frame of the current frame 32 to which the current sub-frame belongs. In particular, the combination may involve a multiplication between both values in the linear domain (corresponding to a sum in the logarithm domain), in which both gain syntax elements are defined. Accordingly, the excitation spectrum is thus scaled according to the syntax element global_gain. Spectral former 142 then performs an LPC based frequency-domain noise shaping to the resulting spectral coefficients followed by an inverse MDCT transformation performed by retransformer 146 to obtain the time-domain synthesis signal. The overlap/transition handler 132 may perform the overlap add process between consecutive TCX sub-frames.

The CELP decoder 130 acts on the afore-mentioned CELP sub-frames which have, as noted above, a length of 256 audio samples each. As already noted above, the CELP decoder 130 is configured to construct the current excitation as a combination or addition of scaled adaptive codebook and innovation codebook vectors. The adaptive codebook constructor 150 uses the adaptive codebook index which is retrieved from the bitstream via demultiplexer 122 to find an integer and fractional part of a pitch lag. The adaptive codebook constructor 150 may then find an initial adaptive codebook excitation vector v'(n) by interpolating the past excitation u(n) at the pitch delay and phase, i.e. fraction, using an FIR interpolation filter. The adaptive codebook excitation is computed for a size of 64 samples. Depending on a syntax element called adaptive filter index retrieved by the bitstream, the adaptive codebook constructor may decide whether the filtered adaptive codebook is $$v(n)=v'(n) \text{ or}$$

$$v(n)=0.18v'(n)+0.64v'(n-1)+0.18v'(n-2).$$

The innovation codebook constructor 148 uses the innovation codebook index retrieved from the bitstream to extract positions and amplitudes, i.e. signs, of excitation pulses within an algebraic codevector, i.e. the innovation codevector c(n). That is, $$c(n) = \sum_{i=0}^{M-1} s_i \delta(n - m_i)$$

Wherein $m_i$ and $s_i$ are the pulse positions and signs and M is the number of pulses. Once the algebraic codevector c(n) is decoded, a pitch sharpening procedure is performed. First the c(n) is filtered by a pre-emphasis filter defined as follows:

$$F_{emph}(z)1-0.3z^{-1}$$

The pre-emphasis filter has the role to reduce the excitation energy at low frequencies. Naturally, the pre-emphasis filter may be defined in another way. Next, a periodicity may be performed by the innovative codebook constructor 148. This periodicity enhancement may be performed by means of an adaptive pre-filter with a transfer function defined as:

$$F_p(z) = \begin{cases} 1 & \text{if } n < \min(T, 64) \\ (1+0.85z^{-T}) & \text{if } T < 64 \text{ and } T \le nM < \min(2T, 64) \\ 1/(1-0.85z^{-T}) & \text{if } 2T < 64 \text{ and } 2T \le n < 64 \end{cases}.$$

where n is the actual position in units of immediately consecutive groups of 64 audio samples, and where T is a rounded version of the integer part $T_0$ and fractional part $T_{0,frac}$ of the pitch lag as given by:

$$T = \begin{cases} T_0 + 1 & \text{if } T_{0,frac} > 2 \\ T_0 & \text{otherwise} \end{cases}$$

The adaptive pre-filter $F_p(z)$ colors the spectrum by damping inter-harmonic frequencies, which are annoying to the human ear in case of voiced signals.

The received innovation and adaptive codebook index within the bitstream directly provides the adaptive codebook gain $\hat{g}_p$ and the innovation codebook gain correction factor $\hat{\gamma}$. The innovation codebook gain is then computed by multiplying the gain correction factor $\hat{\gamma}$ by an estimated innovation codebook gain $\gamma'_c$. This is performed by gain adapter 152.

In accordance with the above-mentioned first alternative, gain adaptor 152 performs the following steps:

First, $\bar{E}$ which is transmitted via the transmitted global_gain and represents the mean excitation energy per superframe 32, serves as an estimated gain $G'_c$ in db, i.e.

$$\bar{E}=G'_c$$

The mean innovative excitation energy in a superframe 32, $\bar{E}$, is thus encoded with 6 bits per superframe by global_gain, and $\bar{E}$ is derived from global_gain via its quantized version $\hat{g}$ by:

$$\bar{E}=20\cdot\log(\hat{g})$$

The prediction gain in the linear domain is then derived by gain adaptor 152 by:

$$g'_c=10^{0.05G'_c}$$

The quantized fixed-codebook gain is then computed by gain adaptor 152 by $$\hat{g}_c=\hat{\gamma}\cdot g'_c$$

As described, gain adaptor 152 then scales the innovation codebook excitation with $\hat{g}_c$, while adaptive codebook constructor 150 scales the adaptive codebook excitation with $\hat{g}_p$, and a weighted sum of both codebook excitations is formed at combiner 154.

In accordance with the second alternative of the above outlined alternatives, the estimated fixed-codebook gain $g_c$ is formed by gain adaptor 152 as follows:

First, the average innovation energy is found. The average innovation energy $E_i$ represents the energy of innovation in the weighted domain. It is calculated by convoluting the innovation code with the impulse response h2 of the following weighed synthesis filter:

$$H2(z) = \frac{\hat{W}(z)}{\hat{A}(z)} H_{de_emph}(z) = \frac{\hat{A}(z/0.92)}{\hat{A}(z)\cdot(1-0.68z^{-1})}$$

The innovation in the weighted domain is then obtained by a convolution from n=0 to 63:

$$c_w[n]=c[n]*h2[n]$$

The energy is then:

$$Ei = 10\cdot\log\left(\frac{1}{64}\sum_{n=0}^{63} c_w^2[n]\right)$$

Then, the estimated gain $G'_c$ in db is found by $$G'_c=\bar{E}-E_i-12$$

where, again, $\bar{E}$ is transmitted via the transmitted global_gain and represents the mean excitation energy per superframe 32 in the weighted domain. The mean energy in a superframe 32, $\bar{E}$, is thus encoded with 8 bits per superframe by global_gain, and $\bar{E}$ is derived from global_gain via its quantized version $\hat{g}$ by:

$$\bar{E}=20\cdot\log(\hat{g})$$

The prediction gain in the linear domain is then derived by gain adaptor 152 by:

$$g'_c=10^{0.05G'_c}$$

The quantized fixed-codebook gain is then derived by gain adaptor 152 by $$\hat{g}_c=\hat{\gamma}\cdot g'_c$$

The above description did not go into detail as far as the determination of the TCX gain of the excitation spectrum in accordance with the above-outlined two alternatives is concerned. The TCX gain, by which the spectrum is scaled, is—as it was already outlined above—coded by transmitting the element delta_global_gain coded on 5 bits at the encoding side according to:

$$\text{delta_global_gain} = \left\lfloor\left(4\cdot\log_2\left(\frac{\text{gain_tcx}}{\hat{g}}\right)+10\right)+0.5\right\rfloor.$$

It is decoded by the excitation generator 140, for example, as follows:

$$\text{gain_tcx} = 2^{\frac{delta_global_gain-10}{4}}\cdot\hat{g},$$

with ĝ denoting the quantized version of global_gain according to $$\hat{g} = 2^{\frac{global_gain}{4}},$$

with, in turn, global_gain submitted within the bitstream for the LPC frame 32 to which the current TCX frame belongs.

Then, excitation generator 140 scales the excitation spectrum by multiplying each transform coefficient with g with:

$$g = \frac{\text{gain_tcx}}{2 \cdot \text{rms}}$$

According to the second approach presented above, the TCX gain is coded by transmitting the element delta-global-gain coded with variable length codes, for example. If the TCX sub-frame currently under consideration has a size of 1024 only 1-bit may be used for delta-global-gain element, while global-gain may be recalculated and requantized at the encoding side, according to:

$$\text{global_gain} = \lfloor 4 \cdot \log_2(\text{gain_tcx}) + 0.5 \rfloor$$

Excitation generator 140 then derives the TCX gain by $$\hat{g} = 2^{\frac{g_{index}}{4}}$$

Then computing $$\text{gain_tcx} = 2^{\frac{delta_global_gain}{8}} \cdot \hat{g}$$

Otherwise, for the other sizes of TCX, the delta-global-gain may be computed by the excitation generator 140 as follows:

$$\text{delta_global_gain} = \left\lfloor \left( 28 \cdot \log\left( \frac{\text{gain_tcx}}{\hat{g}} \right) + 64 \right) + 0.5 \right\rfloor$$

The TCX gain is then decoded by the excitation generator 140 as follows:

$$\text{gain_tcx} = 10^{\frac{delta_global_gain - 64}{28}} \cdot \hat{g}$$

with then computing $$g = \frac{\text{gain_tcx}}{2 \cdot \text{rms}}$$

In order to obtain the gain by which excitation generator 140 scales each transform coefficient.

For example, delta_global_gain may be directly coded on 7-bits or by using Huffman codes which can produce 4-bits on average. Thus, in accordance with the above embodiment, it is possible to encode audio content using multiple-modes. In the above embodiment, three coding modes have been used, namely FD, TCX and ACELP. Despite using the three different modes, it is easy to adjust the loudness of the respective decoded representation of the audio content encoded into bitstream 36. In particular, in accordance with both approaches described above, it is merely useful to equally increment/decrement the global_gain syntax elements contained in each of the frames 30 and 32, respectively. For example, all these global_gain syntax elements may be incremented by 2 in order to evenly increase the loudness across the different coding modes, or decremented by 2 in order to evenly lower the loudness across the different coding mode portions.

After having described an embodiment of the present application, in the following, further embodiments are described which are more generic and individually concentrate on individual advantage aspects of the multi-mode audio encoder and decoder described above. In other words, the embodiment described above represents a possible implementation for each of the subsequently outlined three embodiments. The above embodiment incorporates all the advantageous aspects to which the below-outlined embodiments merely individually refer. Each of the subsequently described embodiments focuses on an aspect of the above-explained multi-mode audio codec which is advantageous beyond the specific implementation used the previous embodiment, i.e. which may implemented differently than before. The aspects to which the below-outlined embodiments belong, may be realized individually and do not have to be implemented concurrently as illustratively described with respect to the above-outlined embodiment.

Accordingly, when describing the below embodiments, the elements of the respective encoder and decoder embodiments are indicated by the use of new reference signs. However, behind these reference signs, reference numbers of elements of FIGS. 1 to 4 are presented in parenthesis, with the latter elements representing a possible implementation of the respective element within the subsequently described figures. In other words, the elements in the figures described below, may be implemented as described above with respect to the elements indicated in the parenthesis behind the respective reference number of the element within the figures described below, individually or with respect to all elements of the respective figure described below.

Figure 5A:
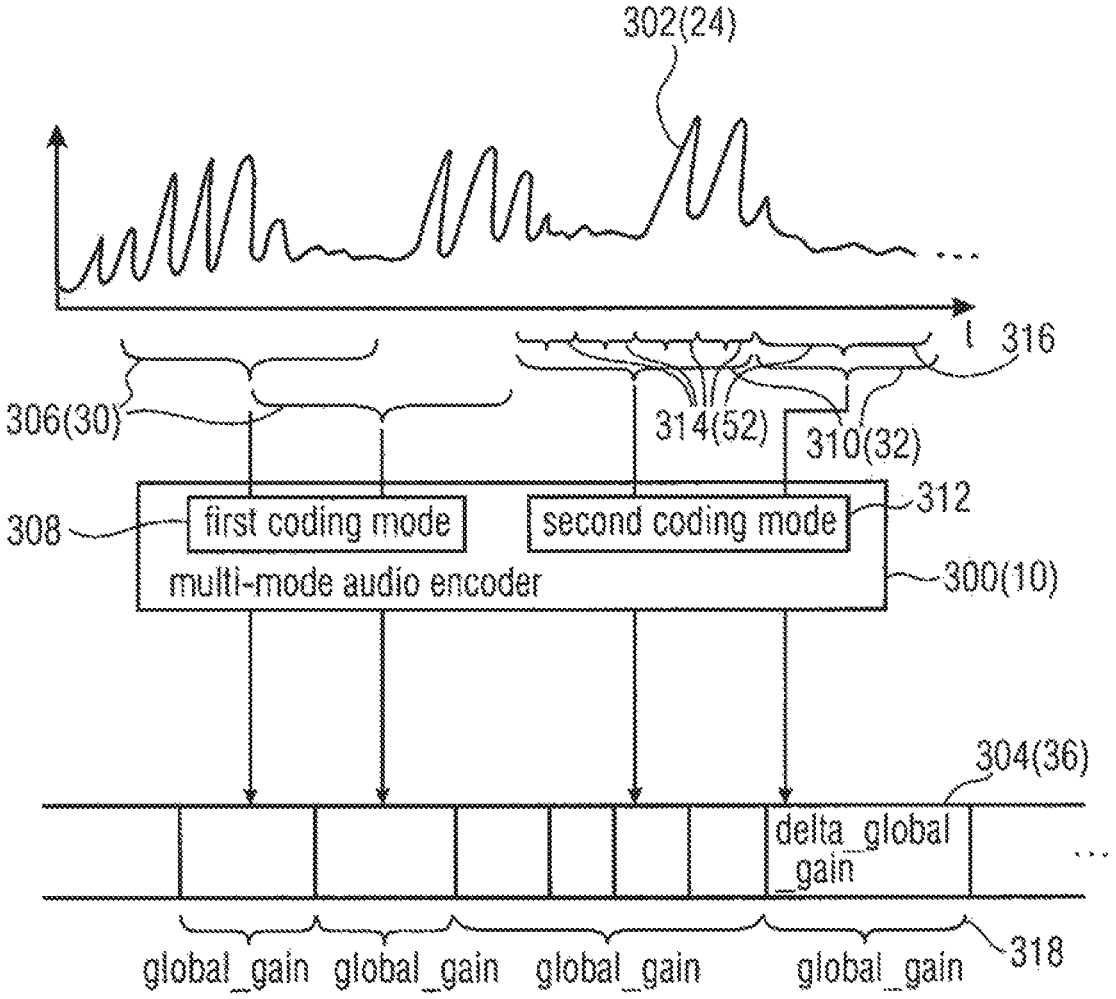
FIGS. 5*a* and 5*b* show a multi-mode audio encoder and a multi-mode audio decoder according to a further embodiment of the present invention.
Figure 5B:
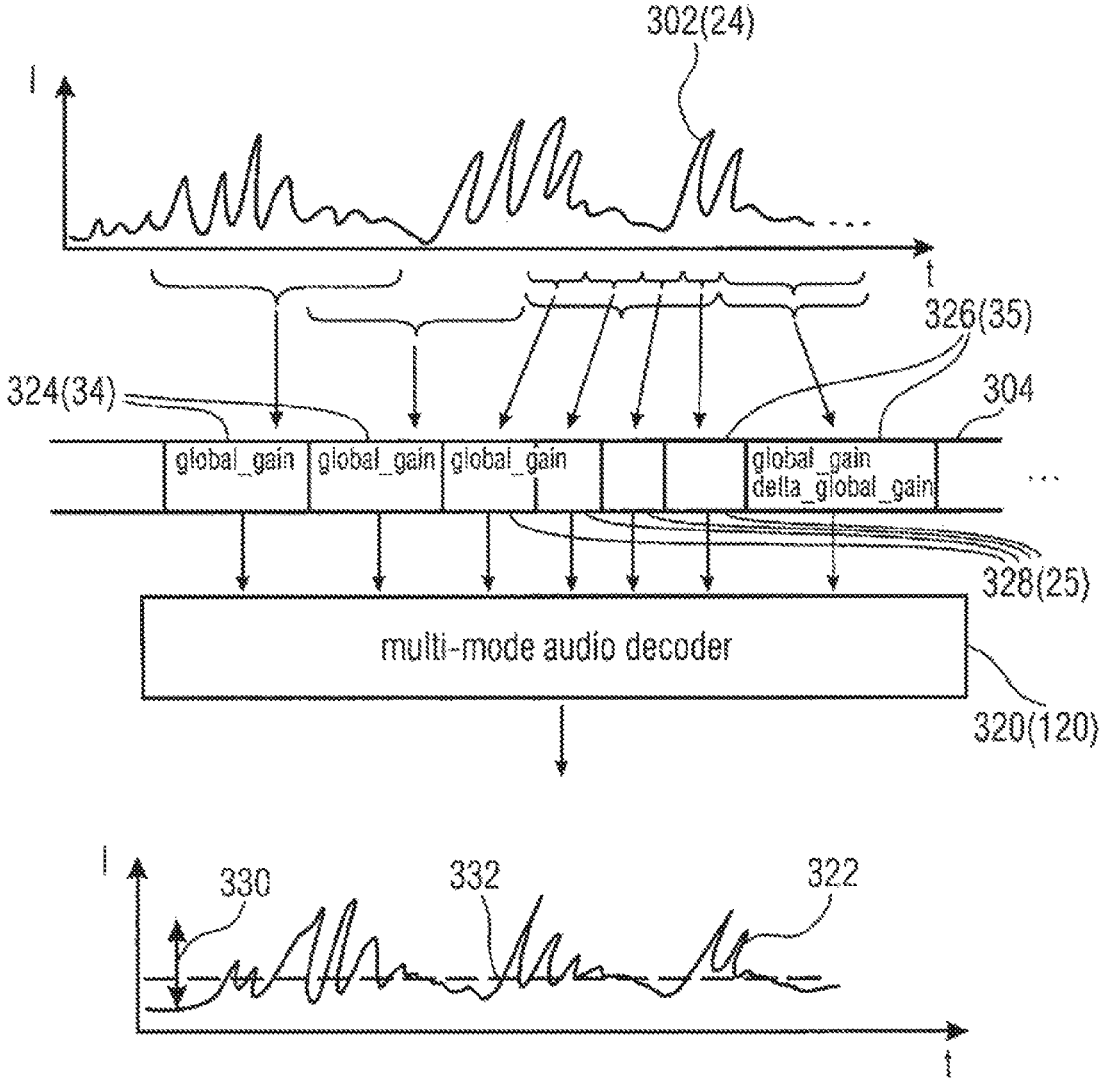

FIGS. 5*a* and 5*b* show a multi-mode audio encoder and a multi-mode audio encoder according to a first embodiment. The multi-mode audio encoder of FIG. 5*a* generally indicated at 300 is configured to encode an audio content 302 into an encode bitstream 304 with encoding a first subset of frames 306 in a first coding mode 308 and a second subset of frames 310 in a second coding mode 312, wherein the second subset of frames 310 is respectively composed of one or more sub-frames 314, wherein the multi-mode audio encoder 300 is configured to determine and encode a global gain value (global_gain) per frame, and determine and encode, per sub-frame of at least a subset 316 of the sub-frames of the second subset, a corresponding bitstream element (delta_global_gain) differentially to the global gain value 318 of the respective frame, wherein the multi-mode audio encoder 300 is configured such that a change of the global gain value (global_gain) of the frames within the encoded bitstream 304 results in an adjustment of an output level of a decoded representation of the audio content at the decoding side.

The corresponding multi-mode audio decoder 320 is shown in FIG. 5*b*. Decoder 320 is configured to provide a decoded representation 322 of the audio content 302 on the basis of an encoded bitstream 304. To this end, the multi-mode audio decoder 320 decodes a global gain value (global_gain) per frame 324 and 326 of the encoded bitstream 304, a first subset 324 of the frames being coded in a first coding mode and a second subset 326 of the frames being coded in a second coding mode, with each frame 326 of the second subset being composed of more than one sub-frame 328 and decode, per sub-frame 328 of at least a subset of the sub-frames 328 of the second subset 326 of frames, a corresponding bitstream element (delta_global_gain) differentially to the global gain value of the respective frame, and completely coding the bitstream using the global gain value (global_gain) and the corresponding bitstream element (delta_global_gain) and decoding the sub-frames of the at least subset of sub-frames of the second subset 326 of frames and the global gain value (global_gain) in decoding the first subset of frames, wherein the multi-mode audio decoder 320 is configured such that a change in the global gain value (global_gain) of the frames 324 and 326 within the encoded bitstream 304 results in an adjustment 330 of an output level 332 of the decoded representation 322 of the audio content.

As it was the case with the embodiments of FIGS. 1 to 4, the first coding mode may be a frequency-domain coding mode, while the second coding mode is a linear prediction coding mode. However, the embodiment of FIGS. 5*a* and 5*b* are not restricted to this case. However, linear prediction coding modes tend to operate with a finer time granularity as far as the global gain control is concerned, and accordingly, using a linear prediction coding mode for frames 326 and a frequency-domain coding mode for frames 324 is advantageous as compared to the contrary case, according to which frequency-domain coding mode was used for frames 326 and a linear prediction coding mode for frames 324.

Moreover, the embodiment of FIGS. 5*a* and 5*b* are not restricted to the case where TCX and ACLEP modes exist for coding the sub-frames 314. Rather, the embodiment of FIGS. 1 to 4 may for example also be implemented in accordance with the embodiment of FIGS. 5*a* and 5*b*, if the ACELP coding mode was missing. In this case, the differential coding of both elements, namely global_gain and delta_global_gain would enable one to account for higher sensitivity of the TCX coding mode against variations and the gain setting with, however, avoiding giving up the advantages provided by a global gain control without the detour of decoding and re-encoding, and without an undue increase of side information necessary.

Nevertheless, the multi-mode audio decoder 320 may be configured to, in completing the decoding of the encoded bitstream 304, decode the sub-frames of the at least subset of the sub-frames of the second subset 326 of frames by using transformed excitation linear prediction coding (namely the four sub-frames of the left frame 326 in FIG. 5*b*), and decode a disjoined subset of the sub-frames of the second subset 326 of the frames by use of CELP. In this regard, the multi-mode audio decoder 220 may be configured to decode, per frame of the second subset of the frames, a further bitstream element revealing a decomposition of the respective frame into one or more sub-frames. In the aforementioned embodiment, for example, each LPC frame may have a syntax element contained therein, which identifies one of the above-mentioned twenty-six possibilities of decomposing the current LPC frame into TCX and ACELP frames. However, again, the embodiment of FIGS. 5*a* and 5*b* are not restricted to ACELP, and the specific two alternatives described above with respect to the mean energy setting in accordance with the syntax element global_gain.

Analogously to the above embodiment of FIGS. 1 to 4, the frames 326 may correspond to frames 310 having, frames 326 or may have, a sample length of 1024 samples, and the at least subset of the sub-frames of the second subset of frames for which the bitstream element delta_global_gain is transmitted, may have a varying sample length selected from the group consisting of 256, 512, and 1024 samples, and the disjoined subset of the sub-frames may have a sample length of 256 samples each. The frames 324 of the first subset may have a sample length equal to each other. As described above. The multi-mode audio decoder 320 may be configured to decode the global gain value on 8-bits and the bitstream element on the variable number of bits, the number depending on a sample length of the respective sub-frame. Likewise, the multi-mode audio decoder may be configured to decode the global gain value on 6-bits and to decode the bitstream elements on 5-bits. It should be noted that there are different possibilities for differentially coding the elements delta_global_gain.

As it as the case with the above embodiment of FIGS. 1 to 4, the global_gain elements may be defined in the logarithmic domain, namely linear with the audio sample intensity. The same applies to delta_global_gain. In order to code delta_global_gain, the multi-mode audio encoder 300 may subject a ratio of a linear gain element of the respective sub-frames 316, such as the above-mentioned gain_TCX (such as the first differentially coded scale factor), and the quantized global_gain of the corresponding frame 310, i.e. the linearized (applied to an exponential function) version of global_gain, to a logarithm such as the logarithm to the base 2, in order to obtain the syntax element delta_global_gain in the logarithm domain. As is known in the art, the same result may be obtained by performing a subtraction in the logarithm domain. Accordingly, the multi-mode audio decoder 320 may be configured to firstly, retransfer the syntax elements delta_global_gain and global_gain by an exponential function to the linear domain in order to multiply the results in the linear domain in order to obtain the gain with which the multi-mode audio decoder has to scale the current sub-frames such as the TCX coded excitation and the spectral transform coefficients thereof, as described above. As is known in the art, the same result may be obtained by adding both syntax elements in the logarithm domain before transitioning into the linear domain.

Further, as described above, the multi-mode audio codec of FIGS. 5*a* and 5*b* may be configured such that the global gain value is coded on fixed number of, for example, eight bits and the bitstream element on a variable number of bits, the number depending on a sample length of the respective sub-frame. Alternatively, the global gain value may be coded on a fixed number of, for example, six bits and the bitstream element on, for example, five bits.

Thus, the embodiments of FIGS. 5*a* and 5*b* focused on the advantage of differentially coding the gain syntax elements of sub-frames in order to account for the different needs of different coding modes as far as the time and bit granularity in the gain control is concerned, in order to on the one hand, avoid unwanted quality deficiencies and to nevertheless achieve the advantages involved with the global gain control, namely avoiding the necessity to decode and re-code in order to perform a scaling of the loudness.

Figure 6A:
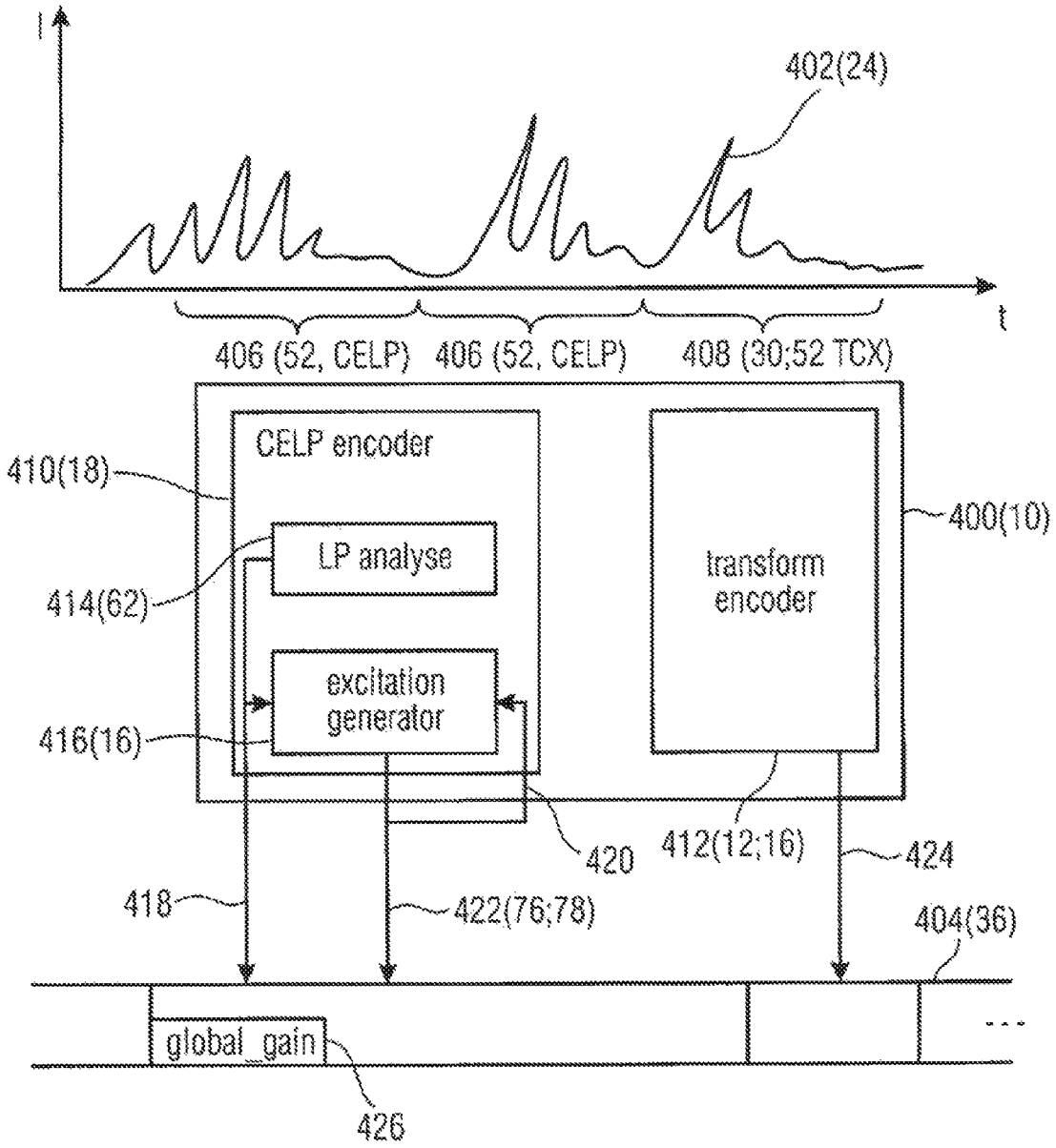
FIGS. 6*a* and 6*b* show a multi-mode audio encoder and a multi-mode audio decoder according to a further embodiment of the present invention.
Figure 6B:
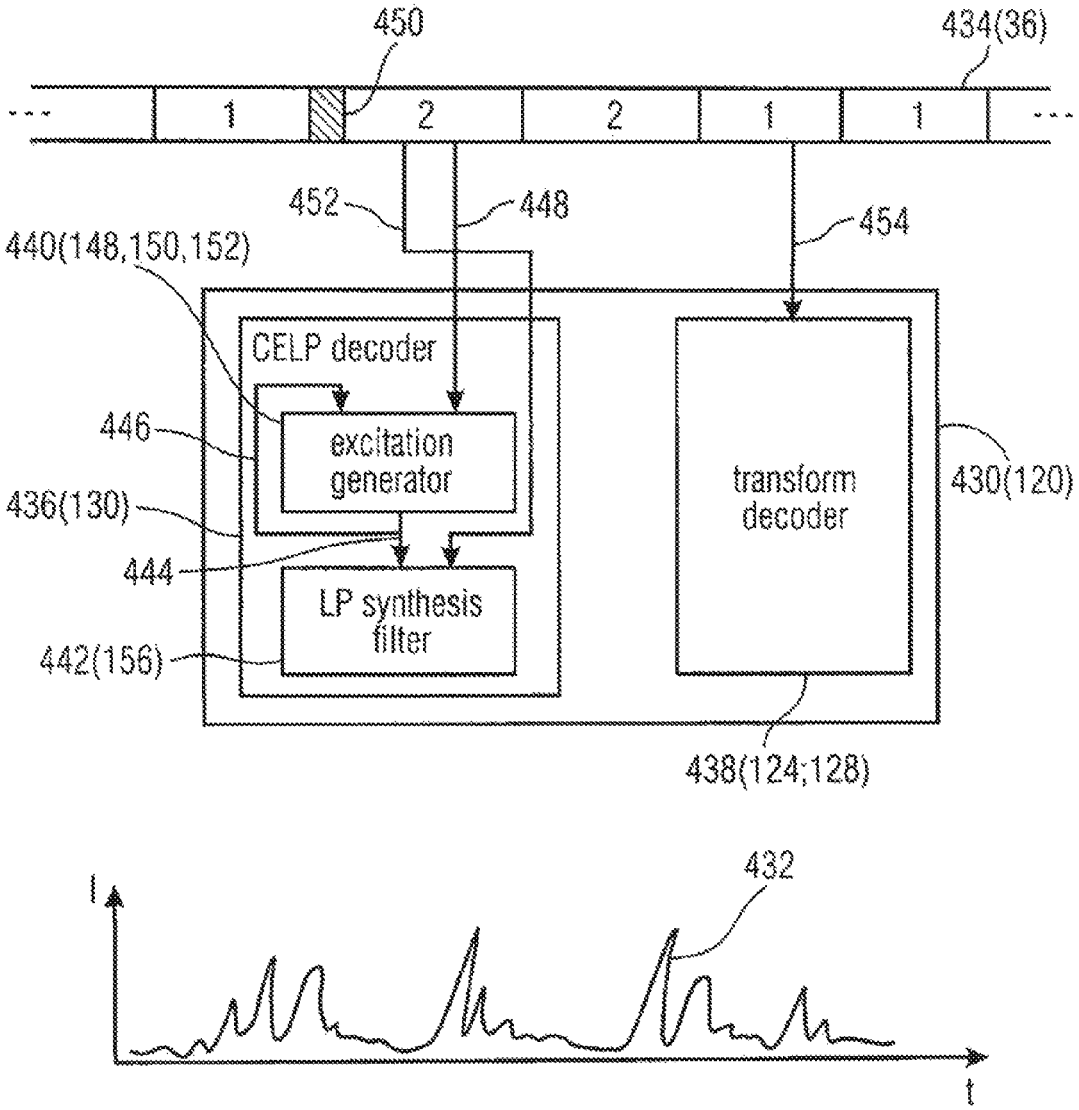

Next, with respect to FIGS. 6*a* and 6*b*, another embodiment for a multi-mode audio codec and the corresponding encoder and decoder is described. FIG. 6*a* shows a multi-mode audio encoder 400 configured to encode and audio content 402 into an encoded bitstream 404 by CELP encoding a first subset of frames of the audio content 402 denoted 406 in FIG. 6*a*, and transform encoding a second subset of the frames denoted 408 in FIG. 6*a*. The multi-mode audio encoder 400 comprises a CELP encoder 410 and a transform encoder 412. The CELP encoder 410, in turn, comprises an LP analyzer 414 and an excitation generator 416. The CELP encoder is configured to encode a current frame of the first subset. To this end, the LP analyzer 414 generates LPC filter coefficients 418 for the current frame and encodes same into the encoded bitstream 404. The excitation generator 416 determines a current excitation of the current frame of the first subset, which when filtered by a linear prediction synthesis filter based on the linear prediction filter coefficients 418 within the encoded bitstream 404, recovers the current frame of the first subset, defined by a past excitation 420 and a codebook index for the current frame of the first subset and encoding the codebook index 422 into the encoded bitstream 404. The transform encoder 412 is configured to encode a current frame of the second subset 408 by performing a time-to-spectral-domain transformation onto a time-domain signal for the current frame to obtain spectral information and encode the spectral information 424 into the encoded bitstream 404. The multi-mode audio encoder 400 is configured to encode a global gain value 426 into the encoded bitstream 404, the global gain value 426 depending on an energy of a version of the audio content of the current frame of the first subset 406 filtered with a linear prediction analysis filter depending on the linear prediction coefficients, or an energy of the time-domain signal. In case of the above embodiment of FIGS. 1 to 4, for example, the transform encoder 412 was implemented as a TCX encoder and the time-domain signal was the excitation of the respective frame. Likewise, the result of filtering the audio content 402 of the current frame of the first subset (CELP) filtered with the linear prediction analysis filter—or the modified version thereof in form of the weighting filter $A(z/\gamma)$—depending on the linear prediction coefficient 418, results in a representation of the excitation. The global gain value 426 thus depends on both excitation energies of both frames.

However, the embodiment of FIGS. 6*a* and 6*b* are not restricted to TCX transform coding. It is imaginable that another transform coding scheme, such as AAC, is mixed up with the CELP coding of CELP encoder 410.

FIG. 6*b* shows the multi-mode audio decoder corresponding to the encoder of FIG. 6*a*. As shown therein, the decoder of FIG. 6*b* generally indicated at 430 is configured to provide a decoded representation 432 of an audio content on the basis of an encoded bitstream 434, a first subset of frames of which is CELP coded (indicated with "1" in FIG. 6*b*), and a second subset of frames of which is transform coded (indicated with "2" in FIG. 6*b*). The decoder 430 comprises a CELP decoder 436 and a transform decoder 438. The CELP decoder 436 comprises an excitation generator 440 and a linear prediction synthesis filter 442.

The CELP decoder 440 is configured to decode the current frame of the first subset. To this end, the excitation generator 440 generates a current excitation 444 of the current frame by constructing a codebook excitation based on a past excitation 446, and a codebook index 448 of the current frame of the first subset within the encoded bitstream 434, and setting a gain of the codebook excitation based on a global gain value 450 within the encoded bitstream 434. The linear prediction synthesis filter is configured to filter the current excitation 444 based on linear prediction filter coefficients 452 of the current frame within the encoded bitstream 434. The result of the synthesis filtering represents, or is used, to obtain the decoded representation 432 at the frame corresponding to the current frame within bitstream 434. the transform decoder 438 is configured to decode a current frame of the second subset of frames by constructing spectral information 454 for the current frame of the second subset from the encoded bitstream 434 and performing a spectral-to-time-domain transformation onto the spectral information to obtain a time-domain signal such that a level of the time-domain signal depends on the global gain value 450. As noted above, the spectral information may be the spectrum of the excitation in the case of the transform decoder being a TCX decoder, or the original audio content in the case of an FD decoding mode.

The excitation generator 440 may be configured to, in generating a current excitation 444 of the current frame of the first subset, construct an adaptive codebook excitation based on a past excitation and an adaptive codebook index of the current frame of the first subset within the encoded bitstream, construct an innovation codebook excitation based on an innovation codebook index for the current frame of the first subset within the encoded bitstream, set, as the gain of the codebook excitation, a gain of the innovation codebook excitation based on the global gain value within the encoded bitstream, and combine the adaptive codebook excitation and the innovation codebook excitation to obtain the current excitation 444 of the current frame of the first subset. That is, an excitation generator 444 may be embodied as described above with respect to FIG. 4, but does not necessarily have to do so.

Further, the transform decoder may be configured such that the spectral information relates to a current excitation of the current frame, and the transform decoder 438 may be configured to, in decoding the current frame of the second subset, spectrally form the current excitation of the current frame of the second subset according to a linear prediction synthesis filter transfer function defined by linear prediction filter coefficients for the current frame of the second subset within the encoded bitstream 434, so that the performance of the spectral-to-time-domain transformation onto the spectral information results in the decoder representation 432 of the audio content. In other words, the transform decoder 438 may be embodied as a TCX encoder, as described above with respect to FIG. 4, but this is not mandatory.

The transform decoder 438 may further be configured to perform the spectral information by converting the linear prediction filter coefficients into a linear prediction spectrum and weighting the spectral information of the current excitation with the linear prediction spectrum. This has been described above with respect to 144. As also described above, the transform decoder 438 may be configured to scale the spectrum information with the global gain value 450. As such, the transform decoder 438 may be configured to construct the spectral information for the current frame of the second subset by use of spectral transform coefficients within the encoded bitstream, and scale factors within the encoded bitstream for scaling the spectral transform coefficients in a spectral granularity of scale factor bands, with scaling the scale factors based on the global gain value, so as to obtain the decoded representation 432 of the audio content.

The embodiment of FIGS. 6*a* and 6*b* highlight the advantageous aspects of the embodiment of FIGS. 1 to 4, according to which it is the gain of the codebook excitation according to which the gain adjustment of the CELP coded portion is coupled to the gain adjustability or control ability of the transform coded portion.

The embodiment described next with respect to FIGS. 7*a* and 7*b* focus on the CELP codec portions described in the abovementioned embodiments without necessitating the existence of another coding mode. Rather, the CELP coding concept, described with respect to FIGS. 7*a* and 7*b*, focuses on the second alternative described with respect to FIGS. 1 to 4 according to which the gain controllability of the CELP coded data is realized by implementing the gain controllability into the weighted domain, so as to achieve a gain adjustment of the decoded reproduction with a fine possible granularity which is not possible to achieve in a conventional CELP. Moreover, computing the afore-mentioned gain in the weighted domain can improve the audio quality.

Figure 7A:
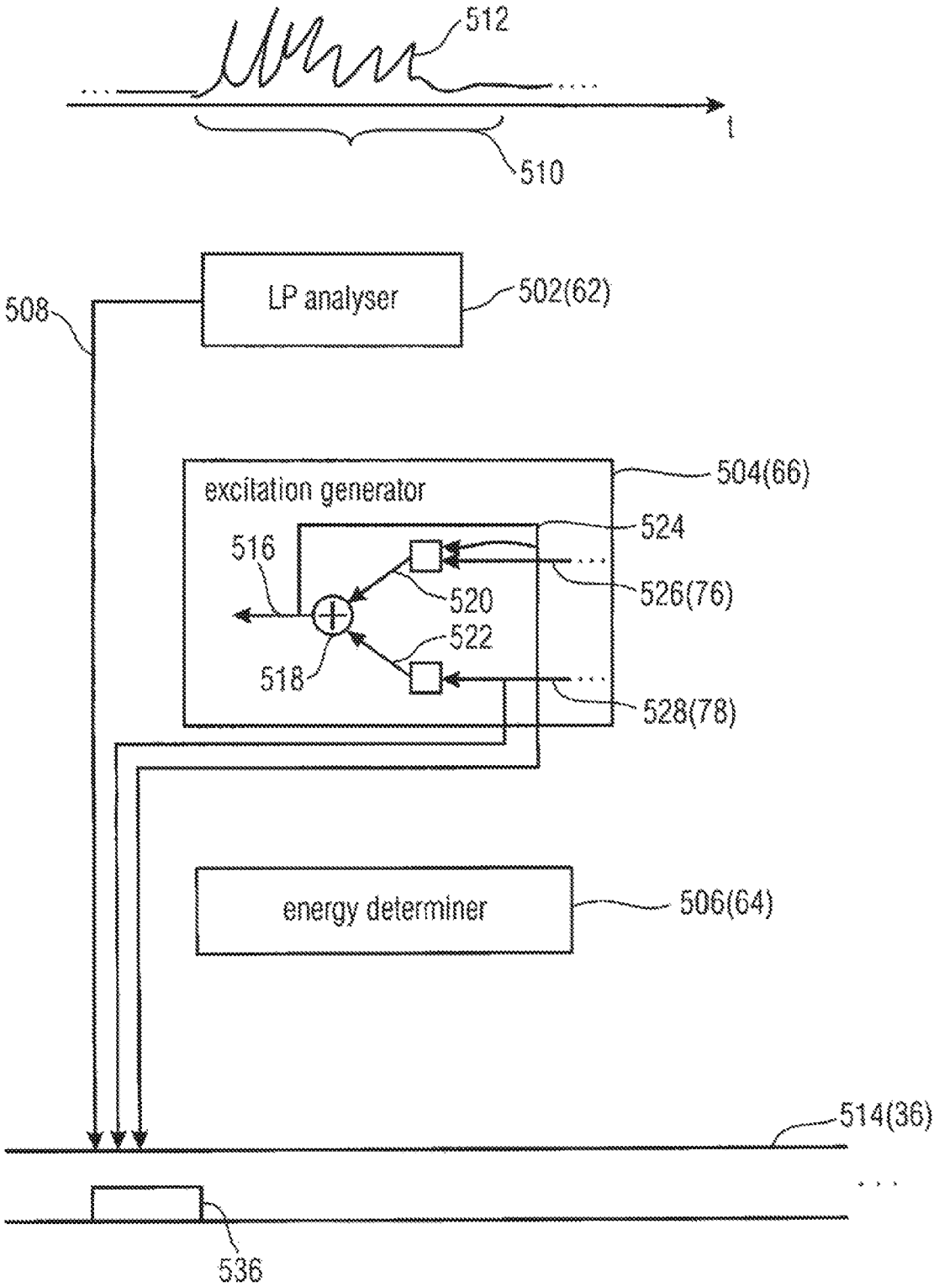
FIGS. 7*a* and 7*b* show a CELP encoder and a CELP decoder according to a further embodiment of the present invention.
Figure 7B:
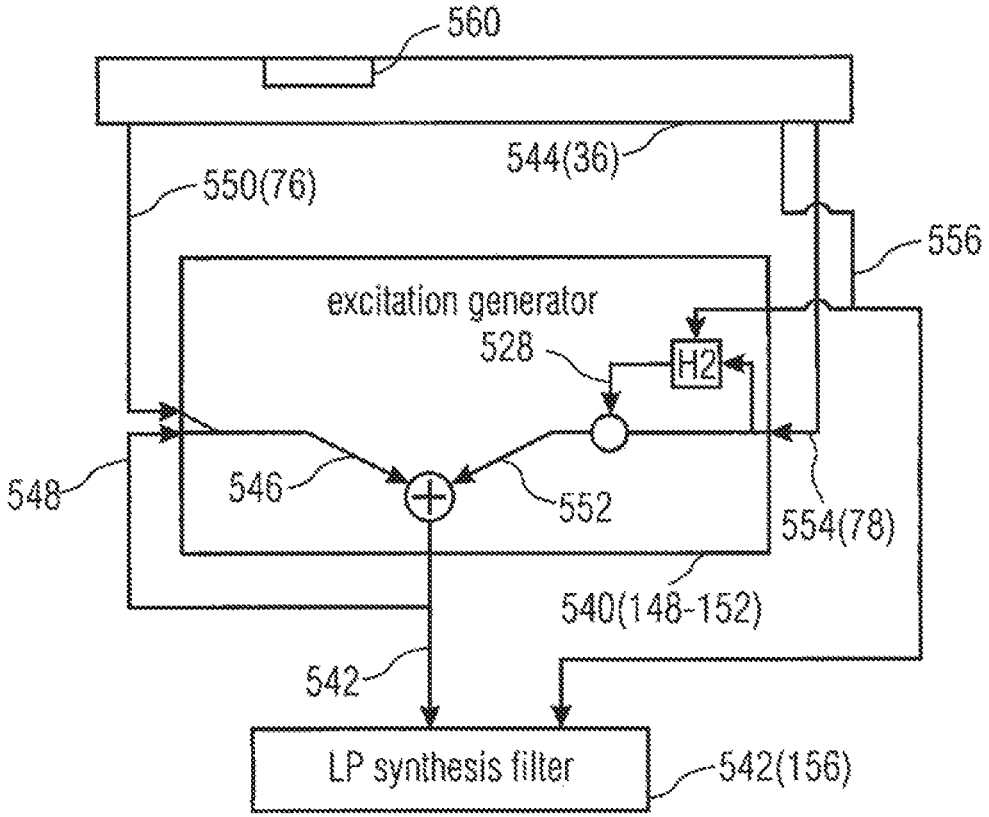

Again, FIG. 7*a* shows the encoder and FIG. 7*b* shows the corresponding decoder. The CELP encoder of FIG. 7*a* comprises an LP analyzer 502, and excitation generator 504, and an energy determiner 506. The linear prediction analyzer is configured to generate linear prediction coefficients 508 for a current frame 510 of an audio content 512 and encode the linear prediction filter coefficients 508 into a bitstream 514. The excitation generator 504 is configured to determine a current excitation 516 of the current frame 510 as a combination 518 of an adaptive codebook excitation 520 and an innovation codebook excitation 522, which when filtered by a linear prediction synthesis filter based on the linear prediction filter coefficients 508, recovers the current frame 510, by constructing the adaptive codebook excitation 520 by a past excitation 524 and an adaptive codebook index 526 for the current frame 510 and encoding the adaptive codebook index 526 into the bitstream 514, and constructing the innovation codebook excitation defined by an innovation codebook index 528 for the current frame 510 and encoding the innovation codebook index into the bitstream 514.

The energy determiner 506 is configured to determine an energy of a version of the audio content 512 of the current frame 510, filtered by a weighting filter issued from (or derived from) a linear predictive analysis to obtain a gain value 530, and encoding the gain value 530 into the bitstream 514, the weighting filter being construed from the linear prediction coefficients 508.

In accordance with the above description, the excitation generator 504 may be configured to, in constructing the adaptive codebook excitation 520 and the innovation codebook excitation 522, minimize a perceptual distortion measure relative to the audio content 512. Further, the linear prediction analyzer 502 may be configured to determine the linear prediction filter coefficients 508 by linear prediction analysis applied onto a windowed and, according to a predetermined pre-emphasis filter, pre-emphasized version of the audio content. The excitation generator 504 may be configured to, in constructing the adaptive codebook excitation and the innovation codebook excitation, minimize a perceptual weighted distortion measure relative to the audio content using a perceptual weighting filter: $W(z)=A(z/\gamma)$, wherein $\gamma$ is a perceptual weighting factor and $A(z)$ is $1/H(z)$, wherein $H(z)$ is the linear prediction synthesis filter, and wherein the energy determiner is configured to use the perceptual weighting filter as a weighting filter. In particular, the minimization may be performed using a perceptual weighted distortion measure relative to the audio content using the perceptual weighting synthesis filter:

$$\frac{A(z/\gamma)}{\hat{A}(z)H_{emph}(z)},$$

wherein $\gamma$ is a perceptual weighting factor, $\hat{A}(z)$ is a quantized version of the linear prediction synthesis filter $A(z)$, $H_{emph}=1-\alpha z^{-1}$ and a is a high-frequency-emphasis factor, and wherein the energy determiner (506) is configured to use the perceptual weighting filter $W(z)=A(z/\gamma)$ as a weighting filter.

Further, for sake of synchrony maintenance between encoder and decoder, the excitation generator 504 may be configured to perform an excitation update, by a) estimating an innovation codebook excitation energy as determined by a first information contained within the innovation codebook index (as transmitted within the bitstream), such as the above-mentioned number, positions and signs of the innovation codebook vector pulses, with filtering the respective innovation codebook vector with H2(z), and determining the energy of the result, b) form a ratio between the energy thus derived and an energy determined by the global_gain in order to obtain a prediction gain $g'_c$ c) multiply the prediction gain $g'_c$ with the innovation codebook correction factor, i.e. the second information contained within the innovation codebook index, to yield the actual innovation codebook gain.

d) actually generate the codebook excitation—serving as the past excitation for the next frame to be CELP encoded—by combining the adaptive codebook excitation and the innovation codebook excitation with weighting the latter with the actual innovation codebook excitation.

FIG. 7*b* shows the corresponding CELP decoder as having an excitation generator 450 and an LP synthesis filter 452. The excitation generator 440 may be configured to generate a current excitation 542 for a current frame 544, by constructing an adaptive codebook excitation 546 based on a past excitation 548 and an adaptive codebook index 550 for the current frame 544, within the bitstream, constructing an innovation codebook excitation 552 based on an innovation codebook index 554 for the current frame 544 within the bitstream, computing an estimation of an energy of the innovation codebook excitation spectrally weighted by a weighted linear prediction synthesis filter H2 constructed from linear prediction filter coefficients 556 within the bitstream, setting a gain 558 of the innovation codebook excitation 552 based on a ratio between a gain value 560 within the bitstream and the estimated energy, and combining the adaptive codebook excitation and innovation codebook excitation to obtain the current excitation 542. The linear prediction synthesis filter 542 filters the current excitation 542 based on the linear prediction filter coefficients 556.

The excitation generator 440 may be configured to, in constructing the adaptive codebook excitation 546, filter the past excitation 548 with a filter depending on the adaptive codebook index 546. Further, the excitation generator 440 may be configured to, in constructing the innovation codebook excitation 554 such that the latter comprises a zero vector with a number of non-zero pulses, the number and positions of the non-zero pulses being indicated by the innovation codebook index 554. The excitation generator 440 may be configured to compute the estimate of the energy of the innovation codebook excitation 554, and filter the innovation codebook excitation 554 with $$\frac{\hat{W}(z)}{\hat{A}(z)H_{emph}(z)},$$

wherein the linear prediction synthesis filter is configured to filter the current excitation 542 according to $1/\hat{A}(z)$, wherein $\hat{W}(z)=\hat{A}(z/\gamma)$ and $\gamma$ is a perceptual weighting factor, $H_{emph}=1-\alpha z^{-1}$ and $\alpha$ is a high-frequency-emphasis factor, wherein the excitation generator 440 is further configured to compute a quadratic sum of samples of the filtered innovation codebook excitation to obtain the estimate of the energy.

The excitation generator 540 may be configured to, in combining the adaptive codebook excitation 556 and the innovation codebook excitation 554, form a weighted sum of the adaptive codebook excitation 556 weighted with a weighting factor depending on the adaptive codebook index 556, and the innovation codebook excitation 554 weighted with the gain.

Further considerations for LPD mode are outlined in the following list:

- Quality improvements could be achieved by retraining the gain VQ in ACELP for matching more accurately the statistics of the new gain adjustment.
- The global gain coding in AAC could be modified by
  - coding it on 6/7 bits instead of 8 bits as it is done in TCX. It may work for the current operating points but it can be a limitation when the audio input has a resolution greater than 16 bits.
  - increasing the resolution of the unified global gain to match the TCX quantization (this corresponds to the second approach described above): the way the scale factors are applied in AAC, it is not necessary to have such an accurate quantization. Moreover it will imply a lot of modifications in the AAC structure and a greater bits consumption for the scale factors.
- The TCX global gains may be quantized before quantizing the spectral coefficients: it is done this way in AAC and it permits to the quantization of the spectral coefficients to be the only source of error. This approach seems to be the most elegant way of doing. Nevertheless, the coded TCX global gains represent currently an energy, the quantity of which is also useful in ACELP. This energy was used in the afore-mentioned gain control unification approaches as a bridge between the two coding scheme for coding the gains.

The above embodiments are transferable to embodiments where SBR is used. The SBR energy envelope coding may be performed such that the energies of the spectral band to be replicated are transmitted/coded relative to/differentially to the energy of the base band energy, i.e. the energy of the spectral band to which the afore-mentioned codec embodiments are applied.

In the conventional SBR, the energy envelope is independent from the core bandwidth energy. The energy envelope of the extended band is then reconstructed absolutely. In another words, when the core bandwidth is level adjusted it won't affect the extended band which will stay unchanged.

In SBR, two coding schemes may be used for transmitting the energies of the different frequency bands. The first scheme consists in a differential coding in the time direction. The energies of the different bands are differentially coded from the corresponding bands of the previous frame. By use of this coding scheme, the current frame energies will be automatically adjusted in case the previous frame energies were already processed.

The second coding scheme is a delta coding of the energies in the frequency direction. The difference between the current band energy and the energy of the band previous in frequency is quantized and transmitted. Only the energy of the first band is absolutely coded. The coding of this first band energy may be modified and may be made relative to the energy of the core bandwidth. In this way the extended bandwidth is automatically level adjusted when the core bandwidth is modified.

Another approach for SBR energy envelope coding may use changing the quantization step of the first band energy when using the delta coding in frequency direction in order to get the same granularity as for the common global gain element of the core-coder. In this way, a full level adjustment could be achieved by modifying both the index of common global gain of the core coder and the index of the first band energy of SBR when delta coding in frequency direction is used.

Thus in other words, an SBR decoder may comprise any of the above decoders as a core decoder for decoding core-coder portion of a bitstream. The SBR decoder may then decode envelope energies for a spectral band to be replicated, from an SBR portion of the bitstream, determine an energy of the core band signal and scale the envelope energies according to an energy of the core band signal. Doing so, the replicated spectral band of the reconstructed representation of the audio content has an energy which inherently scales with the afore-mentioned global_gain syntax elements.

Thus, in accordance with the above embodiments, the unification of the global gain for USAC can work in the following way: currently there is a 7-bit global gain for each TCX-frame (length 256, 512 or 1024 samples), or correspondingly a 2-bit mean energy value for each ACELP-frame (length 256 samples). There is no global value per 1024-frame, in contrast to the AAC frames. To unify this, a global value per 1024-frame with 8 bit could be introduced for the TCX/ACELP parts, and the corresponding values per TCX/ACELP frames can be differentially coded to this global value. Due to this differential coding, the number of bits for these individual differences can be reduced.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A CELP encoder comprising a linear prediction analyzer configured to generate linear prediction filter coefficients for a current frame of an audio content and encode the linear prediction filter coefficients into a bitstream;

an excitation generator configured to determine a current excitation of the current frame as a combination of an adaptive codebook excitation and an innovation codebook excitation, which, when filtered by a linear prediction synthesis filter based on the linear prediction filter coefficients, recovers the current frame, by constructing the adaptive codebook excitation defined by a past excitation and an adaptive codebook index for the current frame and encoding the adaptive codebook index into the bitstream; and constructing the innovation codebook excitation defined by an innovation codebook index for the current frame and encoding the innovation codebook index into the bitstream; and an energy determiner configured to determine an energy of a version of the audio content of the current frame filtered a weighting filter, to acquire a global gain value and encoding the global gain value into the bitstream, the weighting filter construed from the linear prediction filter coefficients.

2. The CELP encoder according to claim 1, wherein the linear prediction analyzer is configured to determine the linear prediction filter coefficients by linear prediction analysis applied onto a windowed and, according to a predetermined pre-emphasis filter, pre-emphasized version of the audio content.

3. The CELP encoder according to claim 1, wherein the excitation generator is configured to, in constructing the adaptive codebook excitation and the innovation codebook excitation, minimize a perceptual weighted distortion measure relative to the audio content.

4. The CELP encoder according to claim 1, wherein the excitation generator is configured to, in constructing the adaptive codebook excitation and the innovation codebook excitation, minimize a perceptual weighted distortion measure relative to the audio content using a perceptual weighting filter $$W(z)=A(z/\gamma),$$

wherein $\gamma$ is a perceptual weighting factor and $A(z)$ is $1/H(z)$, wherein $H(z)$ is the linear prediction synthesis filter, and wherein the energy determiner is configured to use the perceptual weighting filter as a weighting filter.

5. The CELP encoder according to claim 1, wherein the excitation generator is configured to perform an excitation update to acquire a past excitation of a next frame, by estimating an innovation codebook excitation energy estimate by filtering an innovation codebook vector defined by first information contained within the innovation codebook index with $$\frac{\hat{W}(z)}{\hat{A}(z)H_{emph}(z)},$$

and determining an energy of the result filtering result, wherein $1/\hat{A}(z)$ is the linear prediction synthesis filter and depends on the linear prediction filter coefficients, $\hat{W}(z) = \hat{A}(z/\gamma)$ and $\gamma$ is a perceptual weighting factor, $H_{emph} = 1 - \alpha z^{31\ 1}$ and $\alpha$ is a high-frequency-emphasis factor;

forming a ratio between the innovation codebook excitation energy estimate and an energy determined by the global gain value in order to achieve a prediction gain;

multiplying the prediction gain with an innovation codebook correction factor contained within the innovation codebook index as a second information thereof, to yield an actual innovation codebook gain; and actually generating the past excitation for the next frame by combining the adaptive codebook excitation and the innovation codebook excitation with weighting the latter with the actual innovation codebook gain.

6. A CELP encoding method comprising performing linear prediction analysis to generate linear prediction filter coefficients for a current frame of an audio content and encode the linear prediction filter coefficients into a bitstream;

determining a current excitation of the current frame as a combination of an adaptive codebook excitation and an innovation codebook excitation, which, when filtered by a linear prediction synthesis filter based on the linear prediction filter coefficients , recovers the current frame, by constructing the adaptive codebook excitation defined by a past excitation and an adaptive codebook index for the current frame and encoding the adaptive codebook index into the bitstream; and constructing the innovation codebook excitation defined by an innovation codebook index for the current frame and encoding the innovation codebook index into the bitstream; and determining an energy of a version of the audio content of the current frame filtered a weighting filter, to acquire a global gain value and encoding the global gain value into the bitstream, the weighting filter construed from the linear prediction filter coefficients.

7. A non-transitory computer readable storage medium storing a computer program comprising a program code for performing, when running on a computer, a method according to claim 6.

* * * * *